US008265494B2

(12) United States Patent
Kawamoto et al.

(10) Patent No.: US 8,265,494 B2
(45) Date of Patent: Sep. 11, 2012

(54) IMAGE FORMING APPARATUS INCLUDING A TONER SUPPLY CONTROLLER TO CONTROL A SUPPLY OF TONER

(75) Inventors: Hiroyuki Kawamoto, Kanagawa (JP); Kazunari Tonami, Kanagawa (JP); Shuji Hirai, Tokyo (JP); Hiroshi Okuda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 396 days.

(21) Appl. No.: 12/604,819

(22) Filed: Oct. 23, 2009

(65) Prior Publication Data

US 2010/0111547 A1 May 6, 2010

(30) Foreign Application Priority Data

Oct. 31, 2008 (JP) ..... 2008-280884

(51) Int. Cl.
*G03G 15/08* (2006.01)

(52) U.S. Cl. ..... 399/30; 399/27; 399/258

(58) Field of Classification Search ..... 399/27, 399/30, 62, 254, 258, 259
See application file for complete search history.

(56) References Cited

U.S. PATENT DOCUMENTS 5,787,320 A * 7/1998 Eun et al. ..... 399/59
5,974,229 A * 10/1999 Yoshino ..... 399/62 X
7,450,867 B2 * 11/2008 Itoyama et al. ..... 399/27
2005/0179954 A1 8/2005 Arai et al.
2006/0221415 A1 10/2006 Kawamoto
2007/0127094 A1 6/2007 Kawamoto
2008/0080878 A1 * 4/2008 Tanaka et al. ..... 399/30
2008/0240760 A1 * 10/2008 Tanaka ..... 399/62
2008/0273885 A1 * 11/2008 Koizumi et al. ..... 399/30

FOREIGN PATENT DOCUMENTS

JP 11-174909 7/1999
JP 11-219015 8/1999
JP 2003-186262 7/2003
JP 3452295 7/2003
JP 2006-171177 6/2006
JP 2007-156411 6/2007
JP 2008-299315 12/2008

* cited by examiner

*Primary Examiner* — Sandra Brase
(74) *Attorney, Agent, or Firm* — Oblon, Spivak, McClelland, Maier & Neustadt, L.L.P.

(57) ABSTRACT

An image-information acquiring unit acquires the image information divided at least in one of a main-scanning direction and a sub-scanning direction. A supply control unit calculates basic-supply patterns of a supply amount of toner and controls the supply amount at a supply point in a developing unit using a toner supply pattern combined with the basic-supply patterns that eliminate temporal variation in toner density of the developer, at the specific point, due to development of the latent image.

12 Claims, 20 Drawing Sheets

IMAGE FORMING APPARATUS INCLUDING A TONER SUPPLY CONTROLLER TO CONTROL A SUPPLY OF TONER

CROSS-REFERENCE TO RELATED APPLICATIONS

The present application claims priority to and incorporates by reference the entire contents of Japanese Patent Application No. 2008-280884 filed in Japan on Oct. 31, 2008.

BACKGROUND OF THE INVENTION

1. Field of the Invention

The present invention generally relates to image forming apparatuses and more particularly relates to supply of toner to a developing unit.

2. Description of the Related Art

When two-component developer that circulates in a developer circulation path in a developing device is used in image formation, toner in the two-component developer is consumed in the image formation. The amount of toner equivalent to the consumed toner is supplied (added) to the two-component developer by the toner supplying unit. The following two methods are typically used to supply toner to the two-component developer.

In the first method, the amount of toner that would be consumed in the process of development of latent images is calculated (predicted) using pixel-writing information (image information) that is used when an exposing unit (latent image forming unit) forms the latent images on a latent image carrier. Then, the amount of toner equivalent to the calculated consumption amount of toner is supplied to the two-component developer in one shot, or supplied in small portions intermittently at regular intervals.

In the second method, a toner-density sensor (toner density detecting unit) is arranged at a predetermined location (predetermined detection location) of a screw conveyor (developer conveying unit), which is used for circulating two-component developer in the developing device, and toner density at the detection point is measured by the toner-density sensor. Then, toner is supplied to the two-component developer in one shot or supplied in small portions intermittently at regular intervals in such a manner that the toner density reaches a predetermined target toner density.

In both methods, however, toner is supplied to the two-component developer in one shot or supplied in small portions intermittently at regular intervals. This makes it difficult to solve the problem of uneven toner density of the two-component developer that circulates in the circulation direction in the developing device (hereinafter, simply referred to as "uneven toner density"). Detailed description is given below with reference to drawings.

FIG. 27 is a schematic diagram of an exemplary configuration of the developing device. In the developing device, two screw conveyors, a first screw conveyor 8 and a second screw conveyor 11, circulate two-component developer in the direction indicated by the arrow A. In the developer circulation path, a developing roller 12 is arranged opposite a portion in which the second screw conveyor 11 is arranged, where the two-component developer is raised onto a surface of the developing roller 12 and the two-component developer that passes through a development region returns thereto. In the developer circulation path, a toner supply port 17 is arranged above a portion in which the first screw conveyor 8 is arranged, and toner is supplied to the developing device from the toner supply port 17 by a toner supplying unit (not shown).

Uneven toner density is measured by a toner-density sensor at a point indicated by reference symbol B in FIG. 27.

FIG. 28 is a graph of the relation between toner supply and uneven toner density when toner is supplied to the two-component developer in one shot. FIG. 29 is a graph of the relation between toner supply and uneven toner density when the toner is intermittently supplied to the two-component developer at regular intervals.

In FIGS. 28 and 29, each of the waveforms (consumption waveforms) indicated by the thin line represents a measurement result of toner density, which is measured by the toner-density sensor without supplying additional toner, of the two-component developer after the two-component developer with uniform toner density has been used for developing a predetermined latent image. In other words, the consumption waveform represents an example of the uneven toner density that occurs after the development.

Each of the waveforms (supply waveforms) indicated by the dotted line represents a measurement result of toner density, which is measured by the toner-density sensor, of the two-component developer after the two-component developer with uniform toner density has been used for developing the predetermined latent image and after toner is supplied to the two-component developer using each of the methods.

Each of the waveforms indicated by a two-dot chain line in FIG. 29 represents each of the supply waveforms of toner supplied intermittently, and the supply waveform indicated by the dotted line represents a combination of each of the supply waveforms indicated by the two-dot chain line.

Each of the waveforms indicated by the heavy solid line is a combination of the consumption waveform and the supply waveform and indicates uneven toner density of the two-component developer after it has been used for developing a predetermined latent image and after toner is supplied to the two-component developer using each of the supply methods.

As shown with heavy solid lines in FIGS. 28 and 29, in the method in which the toner is supplied to the two-component developer in one shot (the first method) and in the method in which the toner is intermittently supplied to the two-component developer at regular intervals (the second method), uneven toner density is still present in the two-component developer after the toner is supplied thereto.

At the time of actual image formation, a consumption waveform is not uniformly produced because the consumption waveform varies according to the formed image, i.e., the position or the size of the developed latent image. Accordingly, as in the conventional method, when the toner is supplied at regular intervals and at a constant rate regardless of the variation of the consumption waveform, the problem of uneven toner density of the two-component developer that occurs after the toner is supplied cannot be eliminated.

This point is explained in more detail below. In the developing device shown in FIG. 27, the two-component developer that is conveyed by the second screw conveyor 11 is conveyed along the developer circulation path in a direction orthogonal to the direction in which the two-component developer is conveyed by the developing roller 12, adheres to a surface of the developing roller 12, and is conveyed to a development region. After being used for development at the development region, the two-component developer returns to the developer circulation path and is conveyed by the second screw conveyor 11.

When the latent images are unevenly distributed on the latent image carrier, the two-component developer that has been used for development possibly in a state where it contains a portion that consumes a large amount of toner and a portion that scarcely consumes toner. The two-component developer having that state returns to the developer circulation path. In such a case, uneven toner density occurs in the two-component developer after the two-component developer returns to the developer circulation path. Furthermore, the state of the uneven toner density varies according to the distribution state of the latent image on the latent image carrier.

FIG. 30 is a graph of the relation between distributions of the latent images on the latent image carrier and states of uneven toner density. In FIG. 30, the arrow A indicates the conveying direction in which the two-component developer is conveyed by the second screw conveyor 11. The arrow C indicates the moving direction of the surface of the latent image carrier.

The upper part of FIG. 30 represents three image patterns that are formed on three recording media. The lower part of FIG. 30 is a graph that represents measurement results (consumption waveform) of the toner density, which are measured by the toner-density sensor without supplying additional toner, of the two-component developer after the two-component developer with uniform toner density has been used for developing latent images corresponding to each of the image patterns.

As shown in FIG. 30, the consumption waveforms, i.e., states of uneven toner density, vary according to the distributions of the latent images on the latent image carrier. In FIG. 30, when comparing the image pattern shown on the left side (hereinafter, "left pattern") with the image pattern shown on the right side (hereinafter, "right pattern"), the consumption waveform of the right pattern is broader than that of the left pattern. This is because the two-component developer that develops the right pattern is conveyed a longer distance from a point where the two-component developer that consumes the toner returns to the developer circulation path to the measurement point B for the toner-density sensor and stirred for a longer period by the screw conveyor. In other words, the two-component developer that develops the right pattern is stirred for a longer period than the two-component developer that develops the left pattern during the period of time in which the two-component developer that consumes the toner is conveyed to the measurement point B for the toner-density sensor. This slightly cancels out toner density compared with the two-component developer that develops the left pattern, resulting in broader consumption waveform.

FIG. 31 is a graph that further explains the relation between positions of the latent images on the latent image carrier and states of uneven toner density.

FIG. 31 illustrates three image patterns on which latent images are formed at three different positions in the conveying direction of the two-component developer that is conveyed by the second screw conveyor and two image patterns on which latent images are formed at two different positions in the moving direction of the surface of the latent image carrier. Parts of the image patterns are overlapped. The image patterns have the same image area.

The graph illustrated in the lower part of FIG. 31 represents measurement results (consumption waveform) of toner density, which are measured by the toner-density sensor without supplying additional toner, of the two-component developer after the two-component developer with uniform toner density has been used for developing the latent images that correspond to each of the three image patterns. The graph illustrated in the left part of FIG. 31 represents measurement results (consumption waveform) of toner density, measured by the toner-density sensor without supplying additional toner, of the two-component developer after the two-component developer with uniform toner density has been used for developing the latent images that correspond to each of the three image patterns.

When latent images having the same area are formed at different positions in the conveying direction of the two-component developer that is conveyed by the second screw conveyor, as shown in the lower part of FIG. 31, the consumption waveforms corresponding to the image patterns have a different peak timing, half width (broad state), and minimum toner density. As described above, this is caused by a difference in the conveying distance of the developer between a point where the two-component developer that consumes the toner returns to the developer circulation path and the measurement point B for the toner-density sensor. Specifically, the difference in peak timing is simply caused by the difference in time it takes the two-component developer that consumes the toner to reach the measurement point B. The differences in the half width (broad state) and the minimum toner density are caused by a difference in the amount of two-component developer that consumes the toner stirred during which two-component developer reaches the measurement point B for the toner-density sensor.

When latent images are formed at different positions in the moving direction of the surface of the latent image carrier, as shown in the left part of FIG. 31, the consumption waveforms corresponding to each of the image patterns have different peak timing but have the same half width (broad state) and the same minimum toner density. This is because the two-component developer that consumes the toner used for the image patterns returns to the same position in the developer circulation path, whereby the conveying distances of the developer to the measurement point B are the same. Accordingly, the amount of two-component developer stirred is the same as that stirred during the period in which the two-component developer reaches the measurement point B. That is, the half width (broad state) and the minimum toner density are the same for the image patterns. However, the timing by which the two-component developer that consumes the toner returns to the developer circulation path differs, whereby the peak timing differs accordingly.

As described above, the consumption waveform is not uniformly produced during actual image formation because the consumption waveform varies according to the size of the latent image formed on the latent image carrier and the position of the latent image. Accordingly, in the conventional method, although the average toner density of all of the two-component developer in the developing device can be maintained at a target toner density, it is difficult to reduce uneven toner density of the two-component developer.

Japanese Patent Application Laid-open No. H11-219015 discloses a method of supplying toner in order to reduce uneven toner density in a developing device that is configured to separately control a supply amount of toner that is supplied from a plurality of toner supply ports on the basis of a result of histogram analysis obtained from density distribution of image data. Using this method, uneven toner density of the two-component developer can be eliminated.

Japanese Patent Application Laid-open No. 2006-171177 discloses a method of supplying toner in order to reduce uneven toner density in a developing device with a configuration in which image data is split into a finite number of divisions, and toner is supplied from toner supplying units corresponding to the divisions based on the number of dots in the division.

In the method of supplying toner disclosed in Japanese Patent Application Laid-open No. H11-219015, to eliminate uneven toner density, the amount of toner supplied from the toner supply ports needs to be separately controlled. Specifically, in an embodiment disclosed in Japanese Patent Application Laid-open No. H11-219015, six toner supply ports are arranged, and the supply amount of toner is separately and simultaneously controlled for these six ports. It is actually impossible to eliminate uneven toner density without the configuration in which the supply control of toner is separately and simultaneously performed for that number of toner supply ports.

To separately perform supply control for a plurality of toner supply ports, driving sources that drives toner supplying members for supplying toner from each of the toner supply ports need to be separately arranged for each toner supply port. When compared with a case of using a typical apparatus in which only one driving source for supplying toner is arranged, there is a problem of an increase in the size of apparatuses because the positioning space for the a plurality of driving sources is required or there is an increase in costs for parts required by the plurality of driving sources.

In the method of supplying toner disclosed in Japanese Patent Application Laid-open No. 2006-171177, a plurality of toner supply ports also need to be separately controlled; therefore, the same problem in the technology disclosed in Japanese Patent Application Laid-open No. 2006-171177 occurs.

SUMMARY OF THE INVENTION

It is an object of the present invention to at least partially solve the problems in the conventional technology.

According to an aspect of the present invention, there is provided an image forming apparatus including a latent image forming unit configured to form a latent image by irradiating an image carrier, which rotates or moves, with a light beam according to image information; a conveying unit configured to convey and circulate two-component developer containing toner and carrier in a conveying path; a toner supplying unit configured to supply toner to the two-component developer at a predetermined supply point in the conveying path; a developing unit that develops the latent image formed on the image carrier with the two-component developer; an acquiring unit that acquires the image information in units of divided image information obtained by dividing the image information at least in one of a main-scanning direction and a sub-scanning direction; and a supply control unit that calculates, based on the image information acquired by the acquiring unit, basic-supply patterns of a supply amount of toner in units of the divided image information and controls the supply amount of toner at the supply point using a toner supply pattern combined with calculated basic-supply patterns, the basic-supply patterns eliminating temporal variation in toner density of the two-component developer at a specific point in the conveying path due to development of the latent image according to the image information acquired by the acquiring unit.

According to another aspect of the present invention, there is provided an image forming method implemented on an image forming apparatus, the image forming apparatus comprising a latent image forming unit configured to form a latent image by irradiating an image carrier, which rotates or moves, with a light beam according to image information; a conveying unit configured to convey and circulate two-component developer containing toner and carrier in a conveying path; a toner supplying unit configured to supply toner to the two-component developer at a predetermined supply point in the conveying path; and a developing unit that develops the latent image formed on the image carrier with the two-component developer. The image forming method including acquiring the image information in units of divided image information obtained by dividing the image information at least in one of a main-scanning direction and a sub-scanning direction; and calculating, based on the image information acquired at the acquiring, basic-supply patterns of a supply amount of toner in units of the divided image information and controlling the supply amount of toner at the supply point using a toner supply pattern combined with calculated basic-supply patterns, the basic-supply patterns eliminating temporal variation in toner density of the two-component developer at a specific point in the conveying path due to development of the latent image according to the image information acquired at the acquiring.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

An electrophotographic printer (hereinafter, "printer") serving as an image forming apparatus according to an embodiment of the present invention is described (hereinafter, the embodiment is referred to as "first embodiment").

Figure 1:
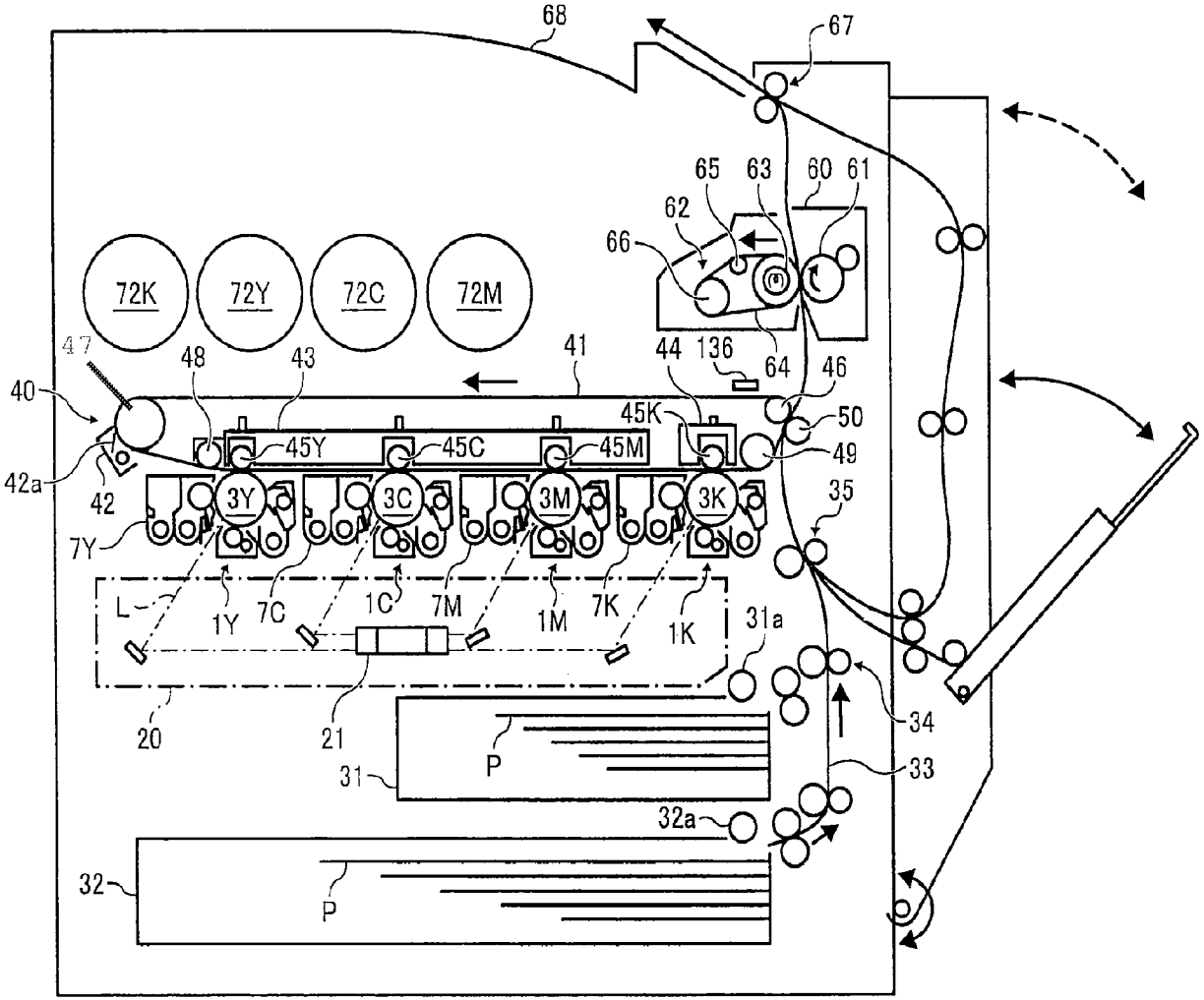
FIG. 1 is a schematic diagram illustrating, in outline, the configuration of a printer according to a first embodiment of the present invention.

The basic configuration of the printer according to the first embodiment is described. FIG. 1 is a schematic diagram illustrating, in outline, the configuration of the printer according to the first embodiment.

The printer includes four process units 1Y, 1C, 1M, and 1K for yellow (Y), cyan (C), magenta (M), and black (K), respectively. The configuration of the process units is the same except for each of the process units contains toner in different colors of Y, C, M, and K serving as an image forming material to form images.

Figure 2:
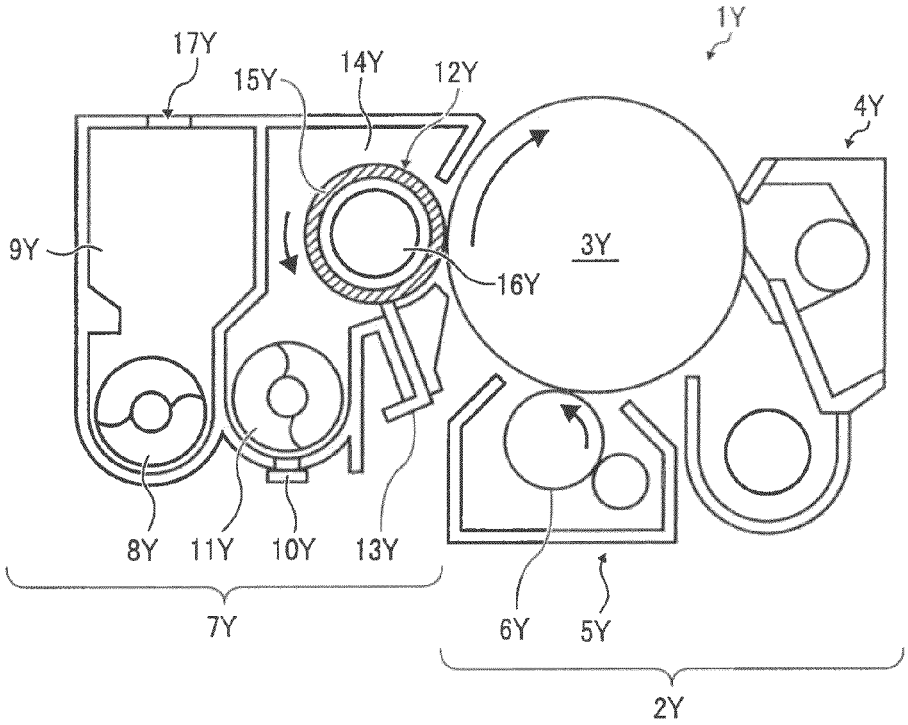
FIG. 2 is a schematic diagram of a process unit.
Figure 3:
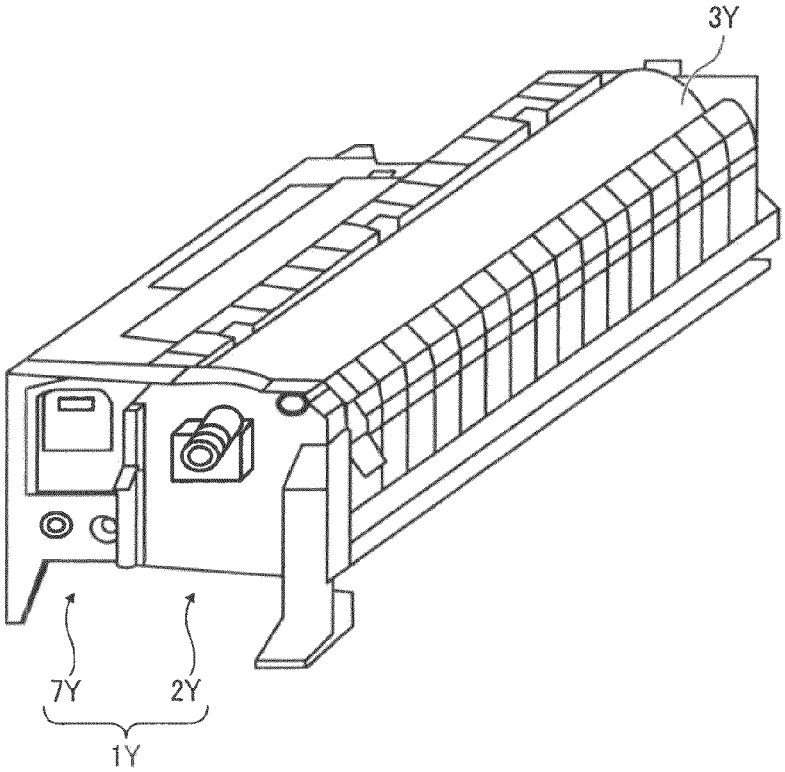
FIG. 3 is an external perspective view of the process unit.

FIG. 2 is a schematic diagram of the process unit 1Y that forms a Y toner image. FIG. 3 is an external perspective view of the process unit 1Y. The process unit 1Y includes a photosensitive element unit 2Y and a developing unit 7Y. As shown in FIG. 3, the photosensitive element unit 2Y and the developing unit 7Y are integrally formed as the process unit 1Y and attached to the printer main body in a detachable manner. The developing unit 7Y can be attached to/detached from the photosensitive element unit 2Y when they are detached from the printer main body.

The photosensitive element unit 2Y includes a drum-shaped photosensitive element 3Y serving as a latent image carrier, a drum cleaning unit 4Y, a neutralizing unit (not shown), a charger 5Y, and the like. The charger 5Y serving as a charging unit uniformly charges a surface of the photosensitive element 3Y, which is driven by a driving unit (not shown) to rotate clockwise in FIG. 2, using a charging roller 6Y. Specifically, a charging bias is applied to the charging roller 6Y that is driven by a power supply (not shown) to rotate counterclockwise in FIG. 2, and the charging roller 6Y is made to close to or come in contact with the photosensitive element 3Y, whereby the surface of the photosensitive element 3Y is uniformly charged. Instead of using the charging roller 6Y, any other charging member such as a charging brush can be used. Alternatively, the surface of the photosensitive element 3Y can be uniformly charged using a charger system charged such as a scorotron charger system. The surface of the photosensitive element 3Y that is uniformly charged by the charger 5Y is exposed and scanned with a laser beam emitted from a later-described optical writing unit 20 serving as a latent image forming unit, whereby an electrostatic latent image for Y is formed on the surface of the photosensitive element 3Y.

Figure 4:
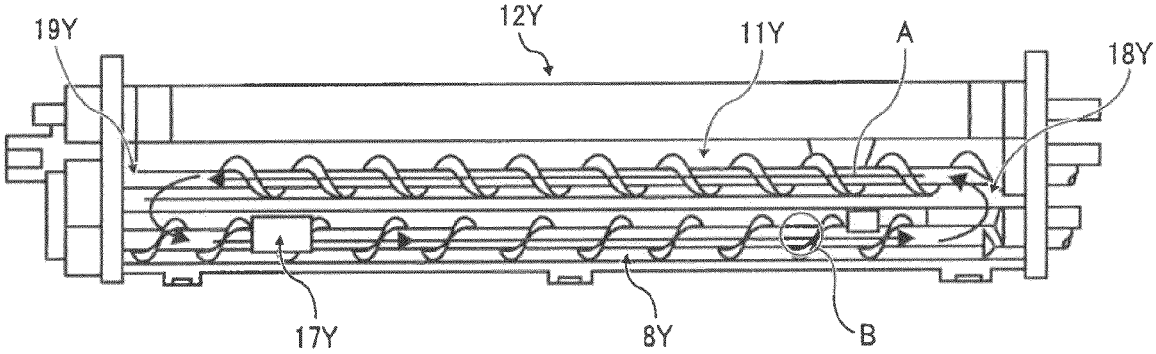
FIG. 4 is a schematic diagram of the configuration of a developing unit around a developer circulation path.

FIG. 4 is a schematic diagram of the configuration of the developing unit around a developer circulation path in which a two-component developer circulates in a developer circulation path in the developing unit. As shown in FIGS. 2 and 4, the developing unit 7Y serving as developing means includes a first developer container 9Y having a first screw conveyor 8Y serving as a developer conveying unit. The developing unit 7Y also includes a toner-density sensor 10Y that is formed of a magnetic permeameter serving as a toner density detecting unit; a second screw conveyor 11Y serving as the developer conveying unit; a developing roller 12Y serving as a developer carrier; and a second developer container 14Y having a doctor blade 13Y serving as a developer shaping member. A Y developer (not shown) corresponding to the two-component developer containing magnetic carrier and negatively charged Y toner is stored in these two developer containers. The first screw conveyor 8Y that is driven to rotate by the driving unit (not shown) conveys the Y developer stored in the first developer container 9Y in the proximal direction in FIG. 2 (direction of the arrow A in FIG. 4). When the Y developer is conveyed, the toner-density sensor 10Y secured to the first screw conveyor BY detects toner density of the Y developer passing through a predetermined detection point located upstream in the developer circulation direction of a point opposing a toner supply port 17Y (hereinafter, "supply point") in the first developer container 9Y. After the first screw conveyor 8Y conveys the Y developer to an end portion of the first developer container 9Y, the Y developer enters a second developer container 14 through a communication port 18Y.

The second screw conveyor 11Y arranged in the second developer container 14Y that is driven to rotate by the driving unit conveys the Y developer toward the distal side in FIG. 2 (direction of the arrow A in FIG. 4). Above the second screw conveyor 11Y that conveys the Y developer in this manner, the developing roller 12Y is arranged parallel to the second screw conveyor 11Y. The developing roller 12Y accommodates a magnet roller 16Y that is securely arranged in a developing sleeve 15Y formed of a non-magnetic sleeve and that is driven to rotate counterclockwise in FIG. 2. A part of the Y developer conveyed by the second screw conveyor 11Y is raised onto a surface of the developing sleeve 15Y by a magnetic force produced by the magnet roller 16Y. The doctor blade 13Y facing the surface of the developing sleeve 15Y with a predetermined gap therebetween shapes a thickness of the Y developer. The Y developer is then conveyed to a development region where the developing sleeve 15Y and the photosensitive element 3Y are opposed each other and makes Y toner adhere onto a Y electrostatic latent image formed on the photosensitive element 3Y, whereby a Y toner image is formed on the photosensitive element 3Y. The Y developer that consumes the Y toner returns to the second screw conveyor 11Y with the rotation of the developing sleeve 15Y. The Y developer conveyed to the end portion of the second developer container 14Y by the second screw conveyor 11Y returns to the first developer container 9Y through a communication port 19Y. In this manner, the Y developer circulates in the developing unit 7Y.

Figure 5:
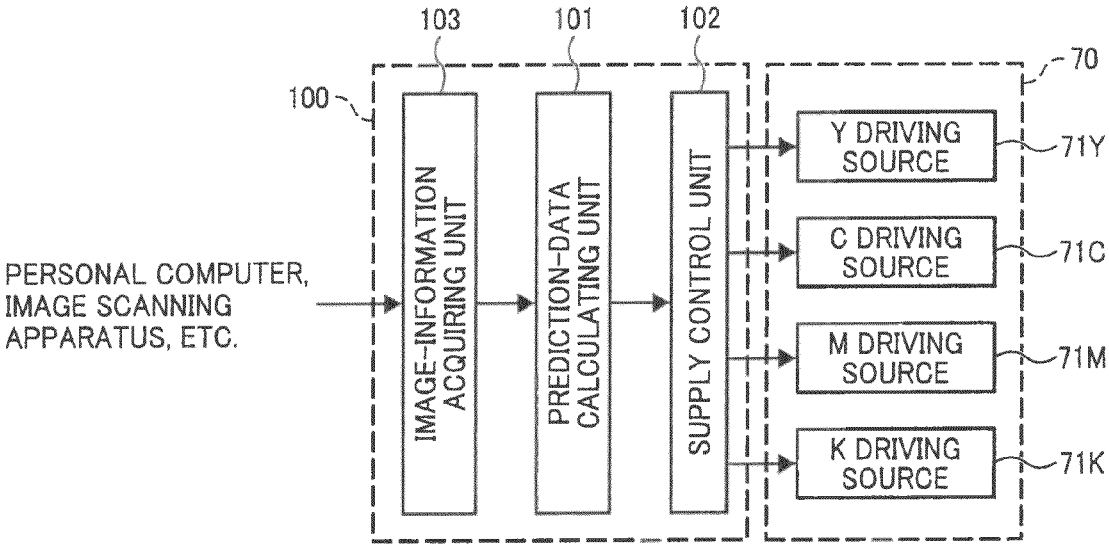
FIG. 5 is a functional block diagram of a mechanism that performs toner supply control.

An outline of toner supply control of supplying toner that is consumed is described. FIG. 5 is a functional block diagram of a mechanism that performs toner supply control. In the first embodiment, a control unit 100 includes an image-information acquiring unit 103 that serves as image-information acquisition means and acquires image data (image information) received from a personal computer or an image scanning apparatus. The image-information acquiring unit 103 sends the acquired image information to a prediction-data calculating unit 101 serving as prediction-data calculation means. The prediction-data calculating unit 101 calculates a temporal variation (prediction data) in toner density, which is measured at the measurement point B based on the received image information, of the developer that consumes toner due to development of the latent image based on the image information.

In the first embodiment, the prediction data is calculated based on the image information that is received from the personal computer or the image scanning apparatus; however, the configuration is not limited thereto. For example, the prediction data can be calculate based on image information obtained by counting the number of laser beams (number of dots) emitted from the optical writing unit 20.

Based on the prediction data calculated by the prediction-data calculating unit 101, a supply control unit 102 serving as supply control means controls a driving sources 71Y, 71C, 71M, and 71K that are the driving sources included in a toner supplying unit 70 serving as toner supplying means. The prediction-data calculating unit 101 calculates, based on the image information, the prediction data indicating the temporal variation in toner density of the Y developer measured at the measurement point B using computing programs or computing tables stored in a read-only memory (ROM). Based on the prediction data calculated by the prediction-data calculating unit 101, the supply control unit 102 controls the driving source 71Y by combining later-described various basic-supply patterns, whereby uneven toner density is eliminated. A detection result of the toner density of the Y developer detected by the toner-density sensor 10Y is sent to the control unit 100 as an electrical signal. The control unit 100 includes a central processing unit (CPU) serving as a computing unit, a random access memory (RAM) serving as a data storage unit, and the ROM and is capable of executing various kinds of computing processing and control program. The control unit 100 stores, in the RAM, Vtref for Y toner corresponding to a target value of an output voltage that is output from the toner-density sensor 10Y and data of Vtref for C, Vtref for M, and Vtref for K corresponding to target values of the output voltage that are output from each corresponding toner-density sensors arranged in each corresponding developing units 7C, 7M, and 7K. Taking the developing unit 7Y containing Y toner as an example, by comparing Vtref for Y with a value of the output voltage that is output from the toner-density sensor 10Y and controls the driving source 71Y of the toner supplying unit 70 to supply the Y toner from the toner supply port 17Y by an amount corresponding to a result of comparison. With this control, in the first developer container 9Y, an appropriate amount of Y toner is supplied to the Y developer that has low density of the Y toner due to consumption of the Y toner for development. Accordingly, the toner density of the Y developer stored in the second developer container 14 is maintained within a range of target toner density. The same control is performed for the developers in the developing units 7C, 7M, and 7K. The toner supply control according to the first embodiment is performed in such a manner that uneven toner density is cancelled out and the description thereof is described later.

The process after a Y toner image is formed on the photosensitive element 3Y is further described. The Y toner image formed on the photosensitive element 3Y is transferred onto an intermediate transfer belt 41 serving as an intermediate transfer unit. The drum cleaning unit 4Y in the photosensitive element unit 2Y cleans the toner remaining on the surface of the photosensitive element 3Y where an intermediate transfer step has been performed. After the cleaning processing, the surface of the photosensitive element 3Y is neutralized by the neutralizing unit (not shown). With this neutralizing process, the surface of the photosensitive element 3Y is initialized and waits for a next image forming operation. In the similar manner, in the process units 1C, 1M, and 1K for other colors, each of a C toner image, an M toner image, and a K toner image is formed on the corresponding one of the photosensitive elements 3C, 3M, and 3K and transferred onto the intermediate transfer belt 41.

The optical writing unit 20 is arranged below the process units 1Y, 1C, 1M, and 1K in FIG. 1. The optical writing unit 20 irradiates the photosensitive elements 3Y, 3C, 3M, and 3K in the process units 1Y, 1C, 1M, and 1K with the laser beam L emitted based on the image information. Accordingly, electrostatic latent images for Y, C, M, and K are formed on the photosensitive elements 3Y, 3C, 3M, and 3K, respectively. A polygon mirror 21 that is driven to rotate by a motor deflects the laser beam L emitted from a light source, and the optical writing unit 20 irradiates the photosensitive elements 3Y, 3C, 3M, and 3K with the laser beam L via a plurality of optical lenses and mirrors. Instead of this configuration, a scanning unit including a light emitting diode array can be used.

As shown in FIG. 1, a first paper feed cassette 31 and a second paper feed cassette 32 are vertically arranged below the optical writing unit 20 in an overlapping manner. A plurality of recording sheets P serving as recording media are stacked as a set and stored in the paper feed cassettes 31 and 32. A first feeding roller 31*a* abuts against the top recording sheet P stored in the first paper feed cassette 31. A second feeding roller 32*a* abuts against the top recording sheet P stored in the second paper feed cassette 32. When the first feeding roller 31*a* is driven by the driving unit to rotate counterclockwise in FIG. 1, the top recording sheet P stored in the first paper feed cassette 31 is discharged toward a feeding path 33 that vertically extends toward the right side of the cassettes in FIG. 1. When the second feeding roller 32*a* is driven by the driving unit to rotate counterclockwise in FIG. 1, the top recording sheet P stored in the second paper feed cassette 32 is discharged toward the feeding path 33. A plurality pairs of conveying rollers 34 are arranged in the feeding path 33. The recording sheet P that is fed to the feeding path 33 is further fed in the feeding path 33 from the lower side toward the upper side in FIG. 1 while being held between the conveying roller 34. A pair of registration rollers 35 is arranged at the end of the feeding path 33. Upon holding the recording sheet P conveyed from the conveying rollers 34 by a nip between the registration rollers 35, the registration rollers 35 once stop its rotation and then convey the recording sheet P toward a later-described secondary transfer nip at an appropriate timing.

A transfer unit 40 that endlessly moves the intermediate transfer belt 41 counterclockwise in FIG. 1 while it is stretched and supported is arranged above the process units 1Y, 1C, 1M, and 1K in FIG. 1. In addition to the intermediate transfer belt 41, the transfer unit 40 includes a belt cleaning unit 42, a first bracket 43, a second bracket 44, and the like. The transfer unit 40 also includes four primary transfer rollers 45Y, 45C, 45M, and 45K; a secondary transfer backup roller 46; a driving roller 47; an auxiliary roller 48; a supporting roller 49; and the like. With the rotation of the driving roller 47, the intermediate transfer belt 41 endlessly moves counterclockwise in FIG. 1 while being stretched and supported by the rollers. The four primary transfer rollers 45Y, 45C, 45M, and 45K and the photosensitive elements 3Y, 3C, 3M, and 3K are opposed each other across the intermediate transfer belt 41, thus forming four primary transfer nips. A transfer bias having opposite polarity to that of the toner (positive polarity in the first embodiment) is applied to the inner circumferential surface of the intermediate transfer belt 41. When the intermediate transfer belt 41 sequentially passes through the primary transfer nips of Y, C, M, and K, the toner images in each color formed on the circumferential surfaces of the photosensitive elements 3Y, 3C, 3M, and 3K are primarily transferred on the outer circumference surface of the intermediate transfer belt 41 in a superimposed manner. In this way, a superimposed four-color toner image (hereinafter, "four-color toner image") is formed on the intermediate transfer belt 41.

The secondary transfer backup roller 46 is opposed to a secondary transfer roller 50 that is arranged on an outer side of a loop of the intermediate transfer belt 41 across the intermediate transfer belt 41, thus forming a secondary transfer nip. The pair of the registration rollers 35 conveys the recording sheet P held between the registration rollers 35 toward the secondary transfer nip at a timing of capable of synchronization with the four-color toner image on the intermediate transfer belt 41. The four-color toner image formed on the intermediate transfer belt 41 is collectively secondary transferred onto the recording sheet at the secondary transfer nip, with the effect of the secondary transfer electric field and the nip pressure that are produced between the secondary transfer backup roller 46 and the secondary transfer roller 50 to which secondary transfer biases are applied. By this process, a full color toner image together with white of the recording sheet P is formed.

The toner that is not transferred onto the recording sheet P remains on the intermediate transfer belt 41 that has passed through the secondary transfer nip. The belt cleaning unit 42 cleans the remaining toner. A cleaning blade 42*a* arranged in the belt cleaning unit 42 is in contact with an outer surface of the intermediate transfer belt 41, whereby the remaining toner on the intermediate transfer belt 41 is removed by scraping it off.

The first bracket 43 of the transfer unit 40 rocks about a rotation shaft of the auxiliary roller 48 over a predetermined angular range by turning a solenoid (not shown) ON/OFF. In the printer according to the first embodiment, when a black-and-white image is formed, the first bracket 43 rotates counterclockwise by a small amount by driving the solenoid. With this rotation, by making primary transfer rollers 45Y, 45C, 45M for Y, C, and M rotate counterclockwise about the rotation shaft of the auxiliary roller 48, the intermediate transfer belt 41 is away from the photosensitive elements 3Y, 3C, and 3M for Y, C, and M. Among four process units 1Y, 1C, 1M, and 1K, the black-and-white image is formed by driving only the process unit 1K for K. By this process, it is possible to avoid ineffective usage of process units for Y, C, and M when forming the black-and-white image.

A fixing unit 60 serving as fixing means is arranged above the secondary transfer nip in FIG. 1. The fixing unit 60 includes a pressing-and-heating roller 61 accommodating a heat source such as a halogen lamp and a fixing-belt unit 62. The fixing-belt unit 62 includes a fixing belt 64, a heating roller 63 accommodating a heat source such as a halogen lamp, a supporting roller 65, a driving roller 66, a temperature sensor (not shown), and the like. The fixing belt 64, which is an endless belt, endlessly moves counterclockwise in FIG. 1 by being stretched and supported by the heating roller 63, the supporting roller 65, and the driving roller 66. During the movement, the heating roller 63 applies heat to the fixing belt 64 from a back surface thereof. A portion in which the fixing belt 64 heated in this manner is wound around the heating roller 63 comes into contact with a front surface of the pressing-and-heating roller 61 that rotates clockwise in FIG. 1. In this way, a fixing nip in which the pressing-and-heating roller 61 comes into contact with the fixing belt 64 is formed.

The temperature sensor (not shown) is arranged on the outer side of the loop of the fixing belt 64 in such a manner that the temperature sensor faces the front surface of the fixing belt 64 with a predetermined gap and detects a surface temperature of the fixing belt 64 just before it enters the fixing nip. A detection result is sent to a fixing power-supply circuit (not shown). Based on the detection result from the temperature sensor, the fixing power-supply circuit controls power supply on and off with respect to the heat sources accommodated in the heating roller 63 and the pressing-and-heating roller 61. By this operation, the surface temperature of the fixing belt 64 is maintained at about 140° C. The recording sheet P passing through the secondary transfer nip is branched off from the intermediate transfer belt 41 and then conveyed into the fixing unit 60. When the recording sheet P is conveyed from the lower portion toward the upper portion in FIG. 1 while being held by the fixing nip in the fixing unit 60, the recording sheet P is heated and pressed by the heating roller 63, whereby the full color toner image is fixed onto the recording sheet P.

The recording sheet P to which fixing processing is subjected in this manner is discharged out of the printer via a discharging roller 67. A stacking unit 68 is arranged on a top surface of the printer main body. The recording sheets P discharged out of the printer by the discharging roller 67 are stacked on the stacking unit 68 one by one.

Four toner cartridges 72Y, 72C, 72M, and 72K, serving as toner containers, that contain Y toner, C toner, M toner, and K toner are arranged above the transfer unit 40. The toner in each color contained in a corresponding one of the toner cartridges 72Y, 72C, 72M, and 72K is appropriately supplied to a corresponding one of the developing units 7Y, 7C, 7M, and 7K of the process units 1Y, 1C, 1M, and 1K by the toner supplying unit 70. The toner cartridges 72Y, 72C, 72M, and 72K are attached to the printer main body in a detachable manner independent of the process units 1Y, 1C, 1M, and 1K.

Figure 6:
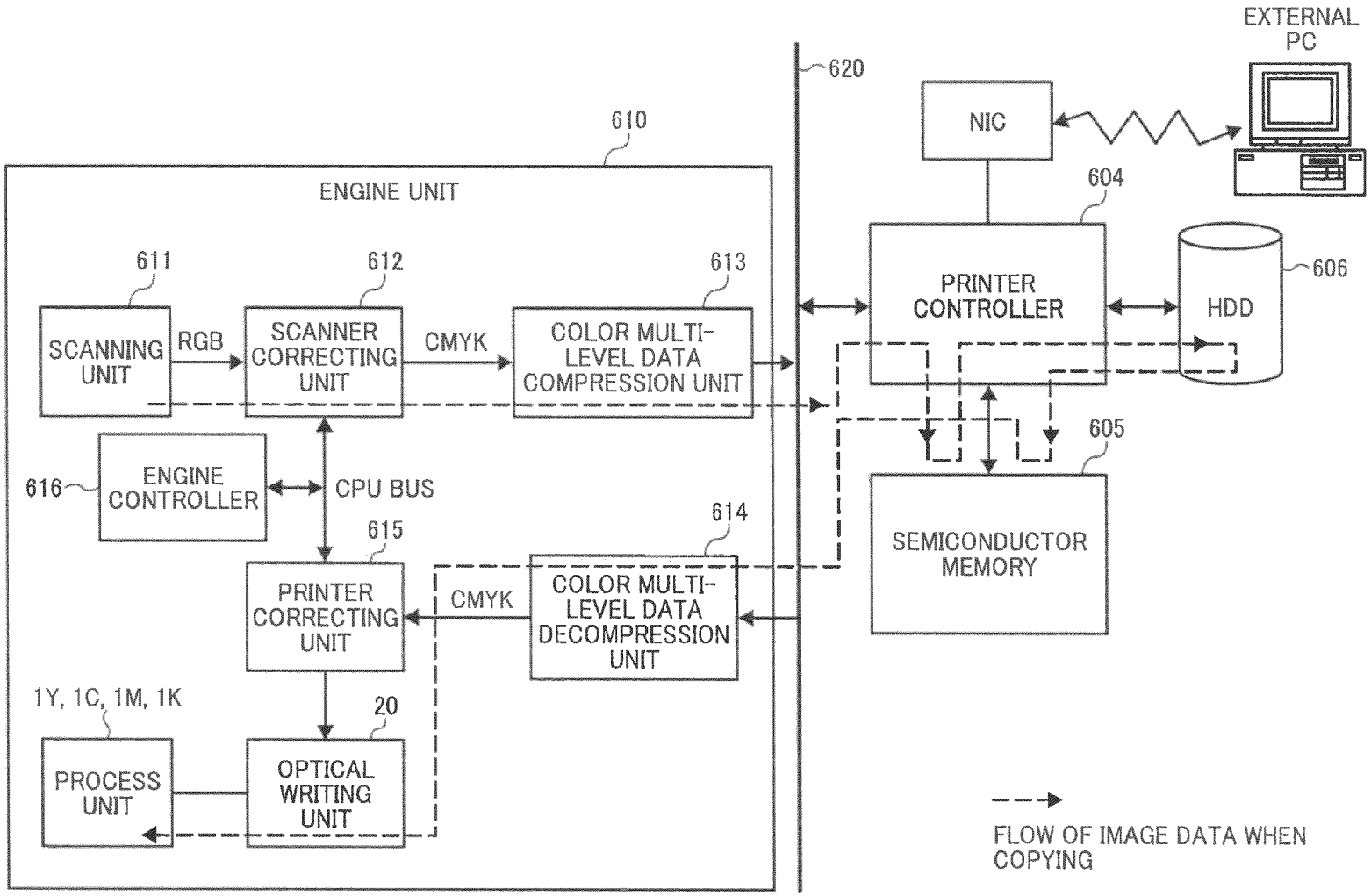
FIG. 6 is a block diagram for explaining a flow of image information acquired by an image-information acquiring unit.

Detailed image information that is acquired by the image-information acquiring unit 103 is described with reference to FIG. 6. For convenience of explanation, a flow of the image information illustrated in FIG. 6 is a case where an image forming apparatus is implemented as an MFP including various functions of, in addition to the printer, a copier, a scanner, and so on. A flow of processing a copy image is described first.

When an original is read out, a scanning unit 611 in an engine unit 610 reads out the image information from the original that is set. The scanning unit 611 sends the read-out image information to a scanner correcting unit 612 as data decomposed into R, G, and B. An engine controller 616 controls of processing each of units arranged in the engine unit 610.

Figure 7:
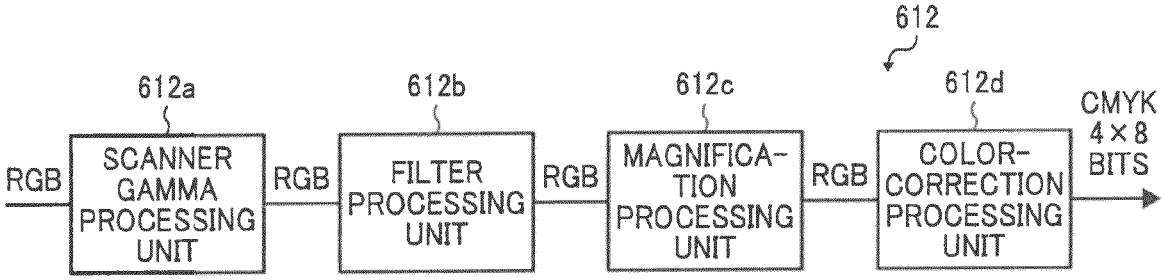
FIG. 7 is a block diagram illustrating the detailed configuration of a scanner correcting unit.

FIG. 7 is a block diagram illustrating the detailed configuration of the scanner correcting unit 612. As shown in FIG. 7, the scanner correcting unit 612 includes a scanner gamma processing unit 612*a* that performs scanner gamma correction; a filter processing unit 612*b* that performs filter processing; a magnification processing unit 612*c* that performs magnification processing; and a color-correction processing unit 612*d* that performs color-correction processing. With the processing, an RGB color signal (image information) is converted to a CMYK color signal (image information).

Referring back to FIG. 6, CMYK color data (image information) of 8 bits (4×8 bits) that has been magnified is converted to color data (image information) of n bit ($n \leqq 8$) by a color multi-level data compression unit 613 that compresses data to fixed length data.

The CMYK image information that is compressed by the color multi-level data compression unit 613 is sent to a printer controller 604 via a general-purpose bus 620. The printer controller 604 has semiconductor memory 605 independent of each other for each color and accumulates therein the received image information.

The accumulated image information is written in a hard disk drive (HDD) 606 as necessary. This process is carried out to avoid re-reading the original and to perform electronic sort even when normal printing does not complete due to paper jam. It is also configured such that the HDD 606 accumulates the read-out image information of the original and outputs it again as necessary.

When outputting the image information, the image information accumulated in the HDD 606 is expanded into the semiconductor memory 605, and then sent to the engine unit 610 via the general-purpose bus. The image information received by the engine unit 610 is again converted to image information containing 8-bit CMYK color data by a color multi-level data decompression unit 614 that extends image with a fixed length used in the engine unit 610. The converted image information is sent to a printer correcting unit 615.

Figure 8:
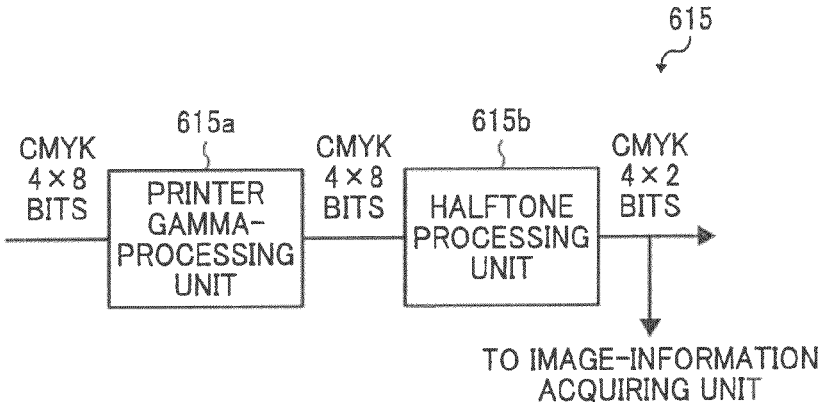
FIG. 8 is a block diagram illustrating the detailed configuration of a printer correcting unit.

FIG. 8 is a block diagram illustrating the detailed configuration of the printer correcting unit 615. As shown in FIG. 8, the printer correcting unit 615 includes a printer gamma-processing unit 615*a* that performs printer gamma correction for each of the CMYK colors; and a halftone processing unit 615*b* that performs halftone processing according to properties of the process units 1Y, 1C, 1M, and 1K. The image information that is subjected to halftone processing is modulated with a laser beam by the optical writing unit 20.

The above description is the case of copying processing. In a case of printer processing, the printer controller 604 directly depicts a bitmap image (image information) in the semiconductor memory 605. The image information, i.e., bitmap data, is directly sent to the optical writing unit 20 via the general-purpose bus without passing the color multi-level data decompression unit 614 and the printer correcting unit 615.

The image information with 2-bit CMYK color data for four channels before being sent to the optical writing unit 20 is sent to the image-information acquiring unit 103. The image-information acquiring unit 103 acquires the image information subjected to grayscale conversion in this manner. The number of bits is reduced in the image information after the grayscale conversion according to the performance of image formation engine. This makes it possible to reduce an amount of computing image information.

Figure 9:
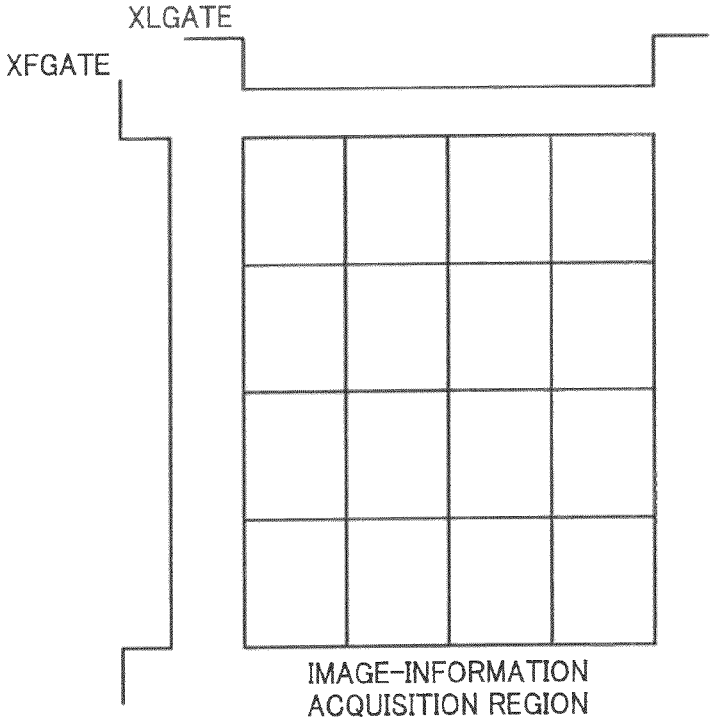
FIGS. 9 and 10 are schematic diagrams illustrating examples of image-information acquisition regions.

The image-information acquiring unit 103 acquires the image information for each region divided at least one of an effective area of the image information in the main-scanning direction (main-scanning effective area) and an effective area of the image information in the sub-scanning direction (sub-scanning effective area). FIG. 9 is a schematic diagram illustrating an example of an image-information acquisition region.

As shown in FIG. 9, the image-information acquiring unit 103 acquires a signal XLGATE indicating the main-scanning effective area, a signal XFGATE indicating the sub-scanning effective area, and the image information that is sent together with a pixel clock (not shown). By counting, for example, the pixel clock after each of the signals is asserted, the image-information acquiring unit 103 can specify the pixel in the two-dimensional plane (image-information acquisition region shown in FIG. 9) that is sent.

Figure 10:
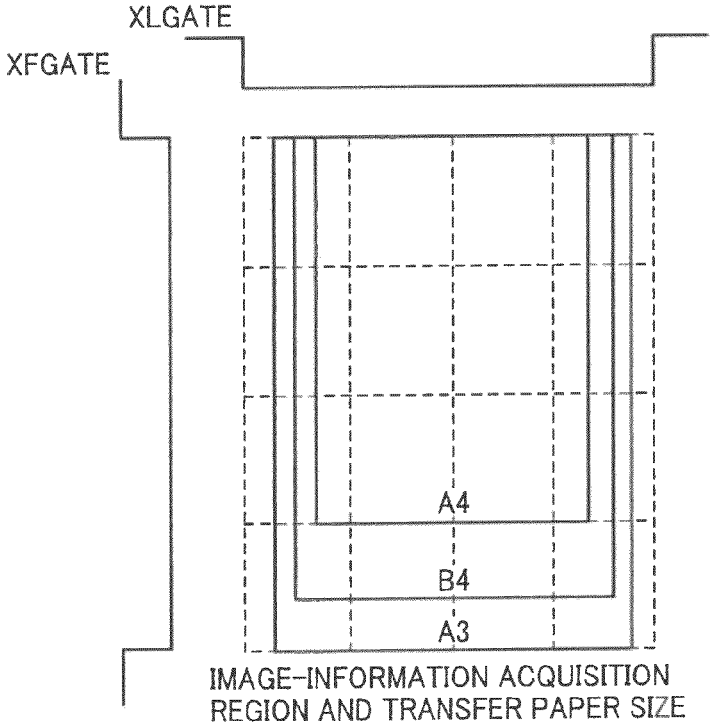

The size of the region for dividing the image-information acquisition region is limited by, as described below, the resolution of the sensor, noise effect, and a performance of small amount of toner supplied by the toner supplying unit 70; however, the size of the region is independent of the size of output image. Therefore, the dividing size of the region is made always constant, regardless of the size of transfer sheet used for printing shown in FIG. 10. This makes it possible to obtain the maximum effect of stable toner density while reducing computing amount.

The image-information acquiring unit 103 sends the image information about each region to the prediction-data calculating unit 101 when the XFGATE is negated. When using an image forming apparatus with a performance of low advection velocity of the developer in the developing unit and a smaller length of a transfer sheet in the sub-scanning direction, even when the image forming apparatus calculates an amount of toner to be supplied after the XFGATE is negated and supplies toner by the toner supplying unit 70, the toner can be supplied in time for the next period of toner consumption. A method of calculating a supply amount of toner in detail is described later.

A basic-supply pattern that is used when the supply control unit 102 drives and controls a driving source 71 is described next. The basic-supply pattern can be obtained in advance by, for example, experiments. Specific processing of obtaining the basic-supply pattern is described below.

First, a toner-density sensor that detects toner density of the Y developer passing through the measurement point B (see FIG. 4) located downstream of the toner supply port 17Y in the first developer container 9Y in the developer circulation direction is arranged.

Figure 11:
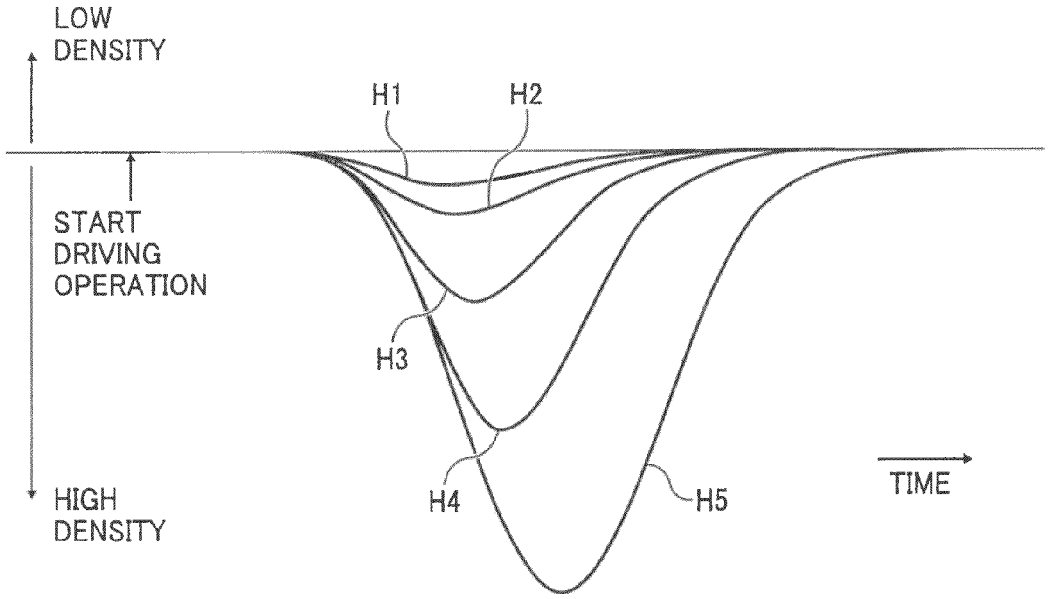
FIG. 11 is a graph of a reference supply pattern performed by a toner supplying unit according to the first embodiment.

A reference pattern (hereinafter, "supply reference pattern") of a toner supply operation performed by the toner supplying unit 70 is then measured. FIG. 11 is a graph of the supply reference pattern obtained by an operation of the toner supplying unit 70 according to the first embodiment.

Each of the waveforms H1, H2, H3, H4, and H5 represents results of detecting temporal variations in the toner density detected by the toner-density sensor (hereinafter, "supply reference waveform") at the measurement point B when toner is supplied using five different supply patterns in which different amount of toner is supplied (hereinafter, "unit of supply amount") to the Y developer with uniform toner density in one operation driven by the driving source 71Y (hereinafter, "supply operation"). The unit of supply amount increases in the order of the supply reference waveforms H1, H2, H3, H4, and H5. The unit of supply amount can be made to vary by changing a driving time and a driving speed of the driving source 71Y in one supply operation.

The surface of the photosensitive element 3Y is divided into multiple regions in the direction orthogonal to the moving direction of the surface of the photosensitive element 3Y (hereinafter, "main-scanning direction"). Latent images in the same image units corresponding to a unit area for detecting the toner density are formed in each of the regions. Temporal variation in the toner density of the Y developer after the Y developer with uniform toner density has been used for developing the latent images is measured by the toner-density sensor at the measurement point B without supplying additional toner (basic consumption waveform). One dot area of the image information is ideally used for the unit area for detecting the toner density when calculating the basic consumption waveform; however, in practice, the size of the region is limited by the resolution of the sensor, noise effect, and a performance of supplying a small amount of toner by the toner supplying unit 70. Accordingly, it is preferable to set the unit area for detecting the toner density as small as possible by taking in consideration of the above-described factors. The intervals of dividing the surface of the photosensitive element 3Y into multiple regions in the above-described manner are appropriately set according to the unit area for detecting the toner density. The basic consumption waveforms measured in this manner are like a graph shown in the lower part of FIG. 30. However, among the above-described multiple regions, only two regions located both ends and one region located at the center are illustrated in the graph shown in the lower part of FIG. 30.

Figure 30:
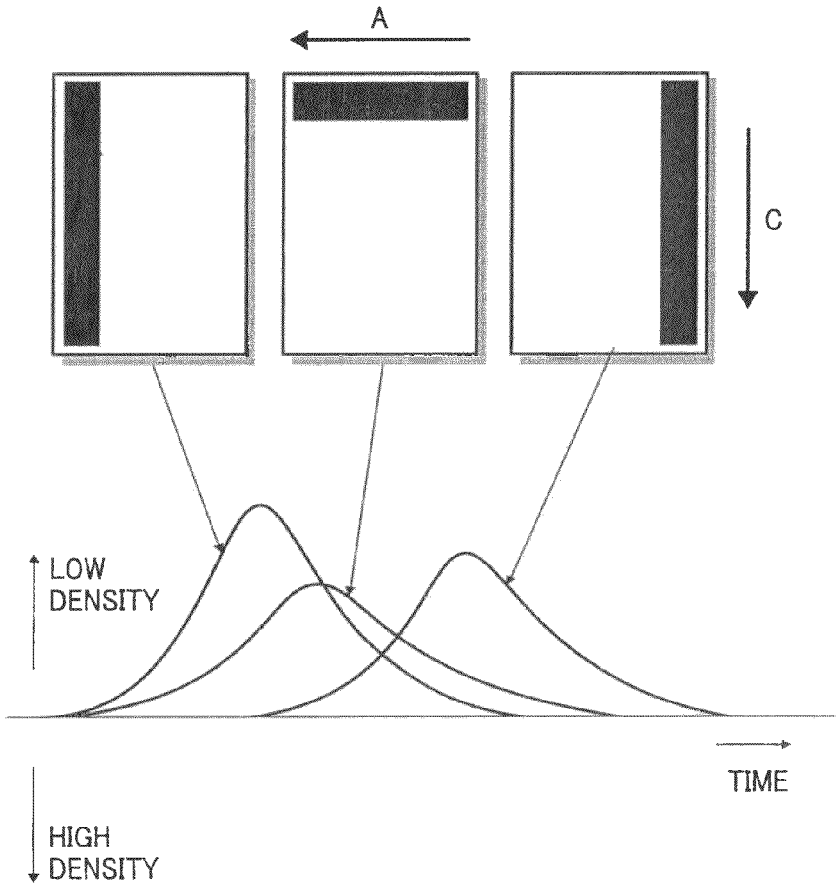
FIG. 30 is an explanatory diagram of the relation between distributions of latent images on latent image carrier and states of uneven toner density.
Figure 31:
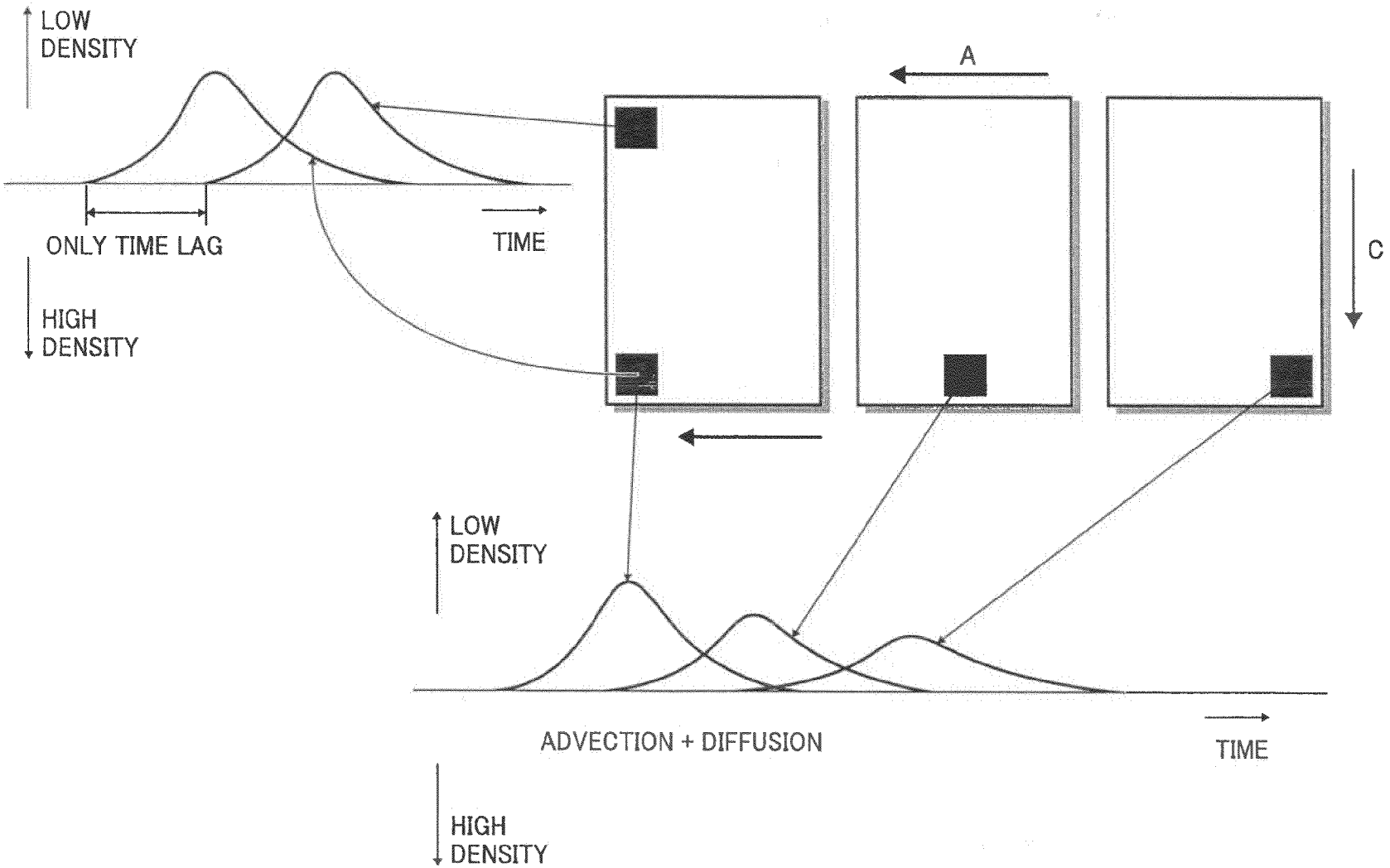
FIG. 31 is an explanatory diagram that further explains the relation between positions of the latent images on the latent image carrier and states of uneven toner density.

In the graph shown in the lower part of FIG. 30, comparing the basic consumption waveforms of three latent images formed at the different positions in the main-scanning direction of the photosensitive element 3Y, the basic consumption waveforms have different half widths (broad state) and different minimum toner density. This is caused by a difference in the conveying distance between a point where the Y developer that consumes the toner due to the development of the latent image returns to the developer circulation path and the measurement point B; therefore, the amount of returned Y developer stirred differs during the period in which the Y developer is conveyed to the measurement point B.

As described above, the consumption waveforms obtained after the development of each of the latent images formed on the different positions of the surface of the photosensitive element 3Y in the moving direction have only the peak timing differences and the half width (broad state) and the minimum toner density thereof are the same. Accordingly, if the basic consumption waveforms of the latent images formed on the same position in the main-scanning direction are acquired, the consumption waveforms of the latent images formed on the different positions of the photosensitive element 3Y in the moving direction can be obtained by simply making the phases of the basic consumption waveforms shift forward and backward by a predetermined time. Therefore, the consumption waveforms of the latent images formed on all positions on the photosensitive element 3Y can be acquired by merely measuring each of the basic consumption waveforms of the latent images in image units for each regions divided the surface of the photosensitive element 3Y in the main-scanning direction.

Figure 12:
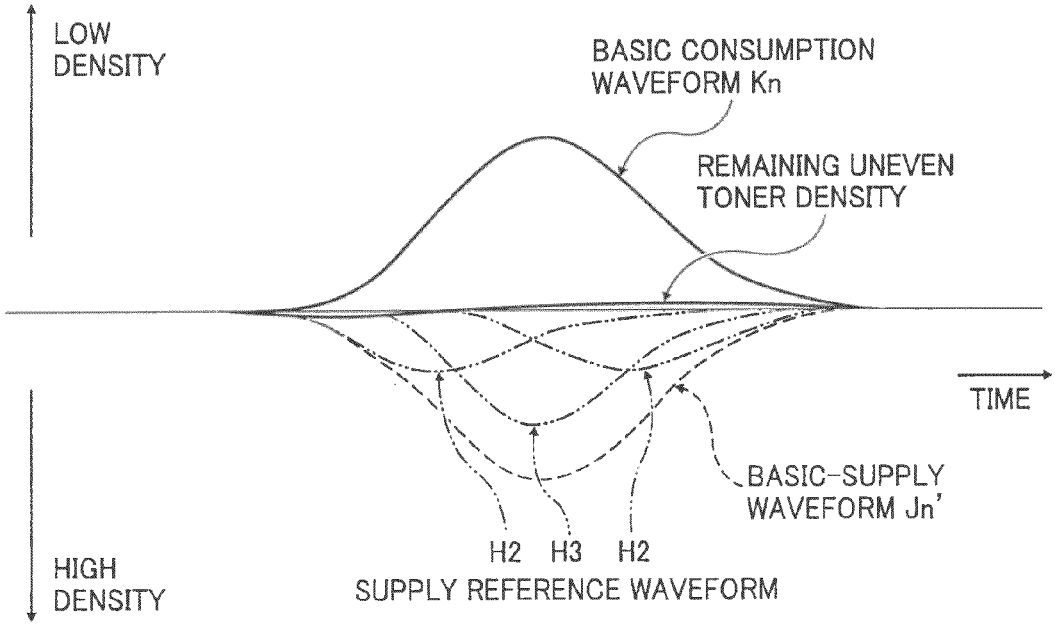
FIG. 12 is a graph of the relation between a basic consumption waveform and a basic-supply waveform.

Next, basic-supply waveforms that cancel out uneven toner density due to each of the basic consumption waveforms Kn are obtained. FIG. 12 is a graph illustrating a certain basic consumption waveforms Kn and a basic-supply waveform Jn' that cancels out the uneven toner density due to the basic consumption waveform Kn.

Based on the basic consumption waveform Kn and each of the supply reference waveforms H1, H2, H3, H4, and H5, by combining the basic consumption waveform Kn with each of the supply reference waveforms H1, H2, H3, H4, and H5, a waveform that cancels out the basic consumption waveform Kn is created as the basic-supply waveform Jn'. When performing the toner supply operation in which the basic-supply waveform Jn' is obtained in this manner, the uneven toner density due to the development of the latent image corresponding to the basic consumption waveform Kn can be eliminated at least at the measurement point B. The toner supply operation corresponding to the combinations of the supply reference waveforms H1, H2, H3, H4, and H5 forming each of the basic-supply waveforms Jn' corresponds to each of the basic-supply patterns.

Figure 13:
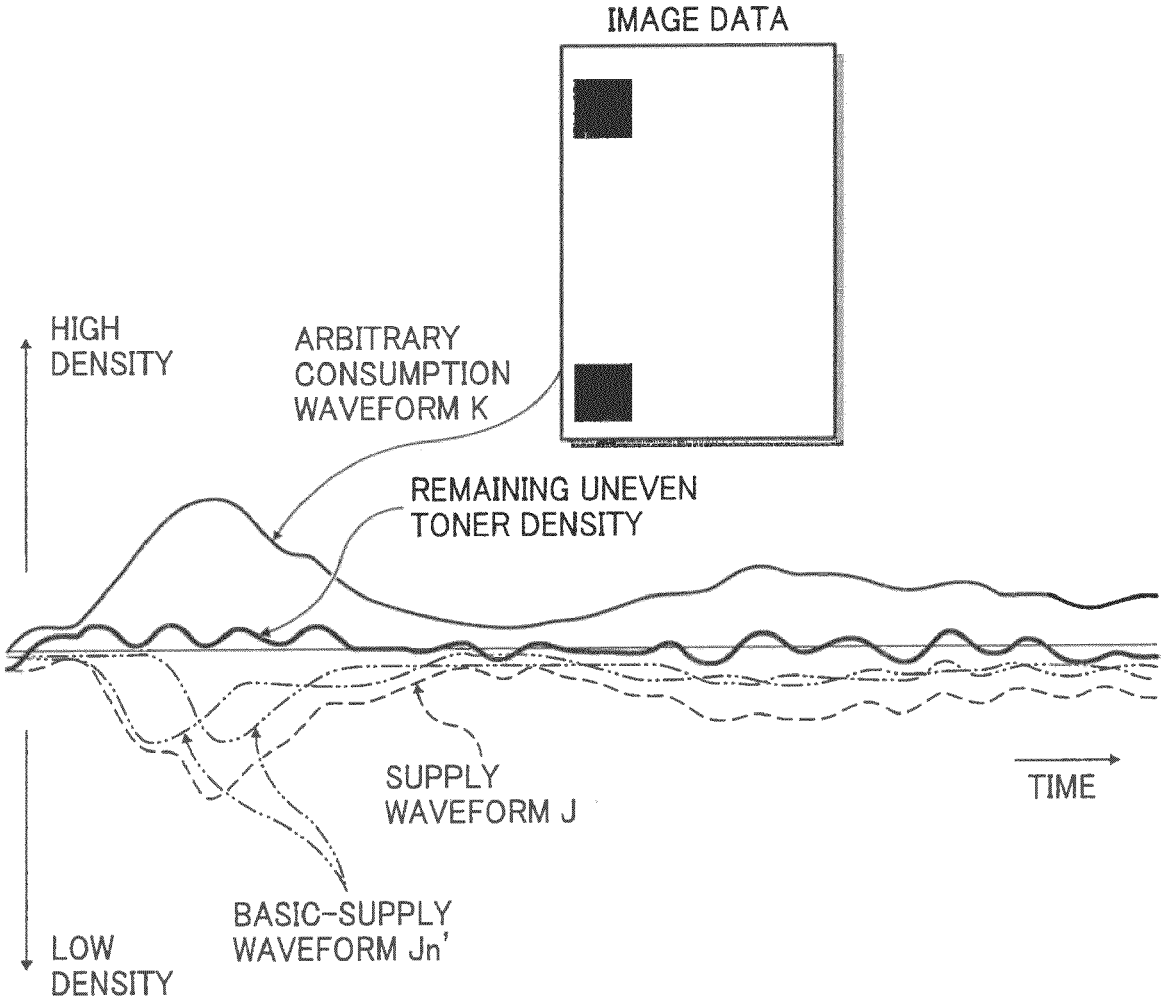
FIG. 13 is a graph of the relation between an arbitrary consumption waveform K and a supply waveform.

A specific toner supply control according to the first embodiment is described next. FIG. 13 is a graph illustrating an arbitrary consumption waveform K obtained when an arbitrary image shown in the upper part of FIG. 13 is formed and a supply waveform J that cancels out uneven toner density due to the arbitrary consumption waveform K.

When an arbitrary image is formed at the time of actual image formation, the image information is sent to the prediction-data calculating unit 101 in the control unit 100. The prediction-data calculating unit 101 decomposes the latent image based on the image information into each position of the photosensitive element 3Y and obtains the basic consumption waveforms Kn corresponding to each of the decomposed latent images. A waveform obtained by combining each of the basic consumption waveforms Kn is a waveform (predicted value) close to the arbitrary consumption waveform K shown in FIG. 13, i.e., close to the consumption waveform indicating the temporal variation in the toner density obtained when the developer that develops the latent images based on the image information passes through the measurement point B.

The image that corresponds to the unit area of the divided region and has pixels with the maximum pixel value is used for image units for obtaining the basic consumption waveform Kn. In the first embodiment, the pixel value has 2 bits (value of 0 to 3) as described above. Accordingly, when pixels smaller than the maximum pixel value are present in the unit area, the predicted value needs to be changed accordingly. Specifically, the prediction-data calculating unit 101 calculates an average of the pixel values of each of the pixels in the divided regions. Then, the prediction-data calculating unit 101 calculates the prediction data by combining a waveform obtained by multiplying the basic consumption waveform Kn by the ratio of the calculated average pixel value to the maximum pixel value (for example, 3). Instead of using the value obtained by dividing the average pixel value by the maximum pixel value, it is possible to use a value obtained by dividing the number of pixels having a pixel value other than zero by the number of total pixels in the unit area.

By executing the predetermined computing program in this manner, the prediction-data calculating unit 101 calculates, based on the above described processing, a plurality of combinations of the basic consumption waveforms Kn corresponding to the decomposed component of an arbitrary consumption waveform K indicating the temporal variation in the toner density of the developer measured when the developer after it has developed the latent image based on the image information passes through the measurement point B as the prediction data.

The prediction data (data of combinations of the basic consumption waveforms Kn) calculated by the prediction-data calculating unit 101 in this manner is sent to the supply control unit 102. As shown in FIG. 13, by combining a plurality of the basic-supply waveforms Jn' in association with the basic consumption waveforms Kn, the supply control unit 102 can create the supply waveform J that cancels out uneven toner density represented by the arbitrary consumption waveform K, i.e., the supply waveform J that is close to a waveform having an opposite phase to the arbitrary consumption waveform K. Accordingly, the supply control unit 102 calculates combinations of the basic-supply waveforms Jn' corresponding to the combinations of the basic consumption waveforms Kn based on the prediction data. Next, the supply control unit 102 determines a toner supply operation (toner supply pattern) that corresponds to the prediction data by combining the various basic-supply patterns stored in the RAM in advance so as to be associated with the obtained combinations of the basic-supply waveforms Jn'.

In a similar manner as in the prediction-data calculating unit 101, the supply control unit 102 determines the toner supply operation by obtaining the toner supply pattern by combining waveforms obtained by dividing an average of the pixel values of each of the pixels in the divided region by the maximum pixel value and multiplying the obtained value by the basic-supply waveform Jn'.

The supply control unit 102 drives and controls the driving source 71Y with the determined toner supply operation (toner supply pattern). Because the supply waveform obtained from such a toner supply operation is the waveform formed by combining the basic-supply waveforms Jn' of each of the basic-supply patterns, supply waveform J shown in FIG. 13 is obtained. Accordingly, by controlling the toner supply in this manner, the uneven toner density indicated by the arbitrary consumption waveform K can be sufficiently eliminated at the measurement point B shown by the heavy solid line in FIG. 13.

As described above, in the first embodiment, the image-information acquiring unit 103 acquires the image information in units of divided image information corresponding to a region obtained by dividing the image-information acquisition region into multiple regions. The above-described process for controlling toner supply can be performed based on each of the image information divided in this manner. By this process, a supply amount of toner can be more accurately calculated compared with a method in which the supply amount of toner is calculated based on image information acquired all at once without dividing the image information.

Figure 14:
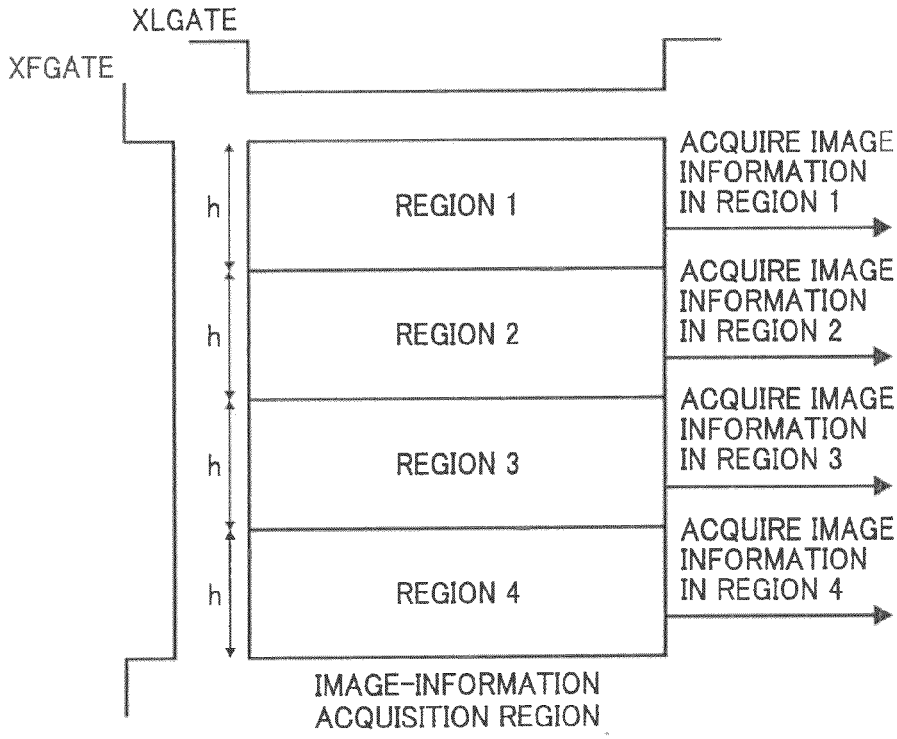
FIG. 14 is a schematic diagram of an example of an image-information acquisition region.

In the above-described embodiment, as shown in FIG. 9, the image information in the image-information acquisition region is divided both in the main-scanning direction and in the sub-scanning direction; however, the configuration is not limited thereto. For example, the image information can be acquired by dividing the image-information acquisition region only in the sub-scanning direction. FIG. 14 is a schematic diagram of an example of image-information acquisition region in such a configuration. With this configuration, the number of divisions can be reduced; therefore, an amount of computation for determining the supply amount of toner can be reduced accordingly.

In the first embodiment, the image-information acquiring unit 103 sends the image information in each region to the prediction-data calculating unit 101 when the XFGATE is negated; however, the configuration is not limited thereto. For example, the image-information acquiring unit 103 can send the image information to the prediction-data calculating unit 101 immediately after acquiring the image information that is written by the optical writing unit 20. FIG. 14 illustrates a state of acquiring the image information with such a configuration.

Specifically, when the image-information acquisition region is divided into four, i.e., a region 1 to a region 4 like that shown in FIG. 14, the image information in each acquired region is sent to the prediction-data calculating unit 101 upon completion of acquiring the image information.

With this configuration, even when an advection velocity of the developer is high, toner can be supplied without delay by a consumed amount so long as satisfying predetermined conditions. A condition for supplying toner without delay is described below.

Figure 15:
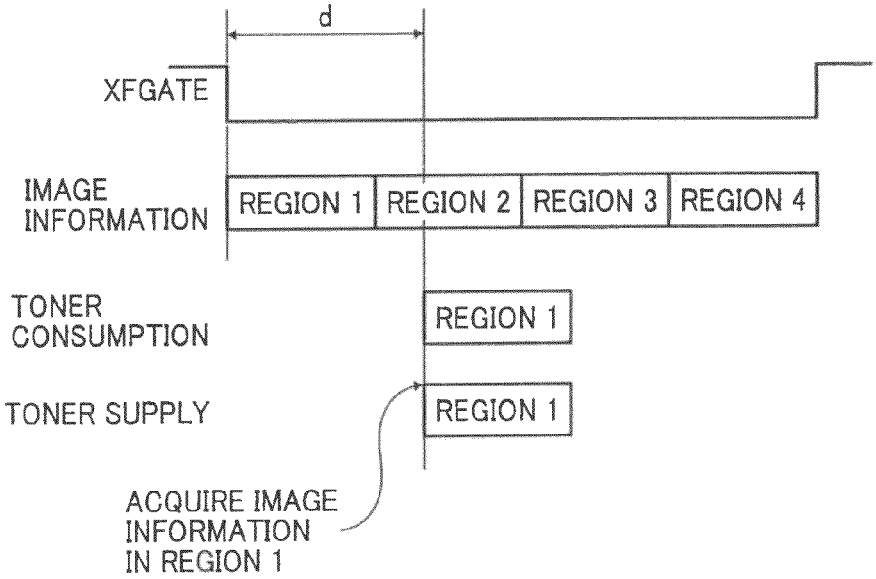
FIG. 15 is a schematic diagram of the relation between writing of image information and toner consumption.

FIG. 15 is a schematic diagram of the relation between writing of the image information and toner consumption. FIG. 15 shows writing of the image information in the region 1 and a time d required for the developer that consumes toner reaches the toner supply port. The reason for the occurrence of the time d is described with reference to FIGS. 16 and 17.

Figure 16:
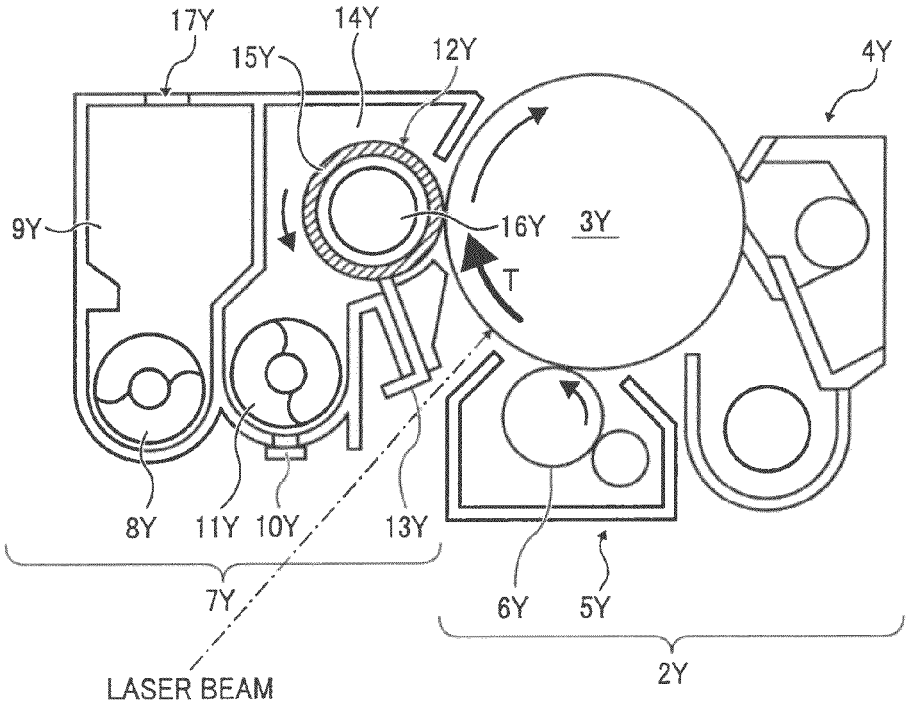
FIG. 16 is a schematic diagram of a writing position of a laser beam, which is added to the schematic diagram of the process unit shown in FIG. 2.

FIG. 16 is a schematic diagram of a writing position of a laser beam, which is added to the schematic diagram of the process unit 1Y shown in FIG. 2. As shown in FIG. 16, a time is required due to the rotation of the photosensitive element 3Y from when the latent image is formed on the photosensitive element 3Y with the laser beam until the latent image reaches the magnet roller 16Y. When a distance from the writing position of the laser beam to the magnet roller 16Y is T and a linear velocity of the photosensitive element 3Y is v, the time thereof is given by T/v.

Figure 17:
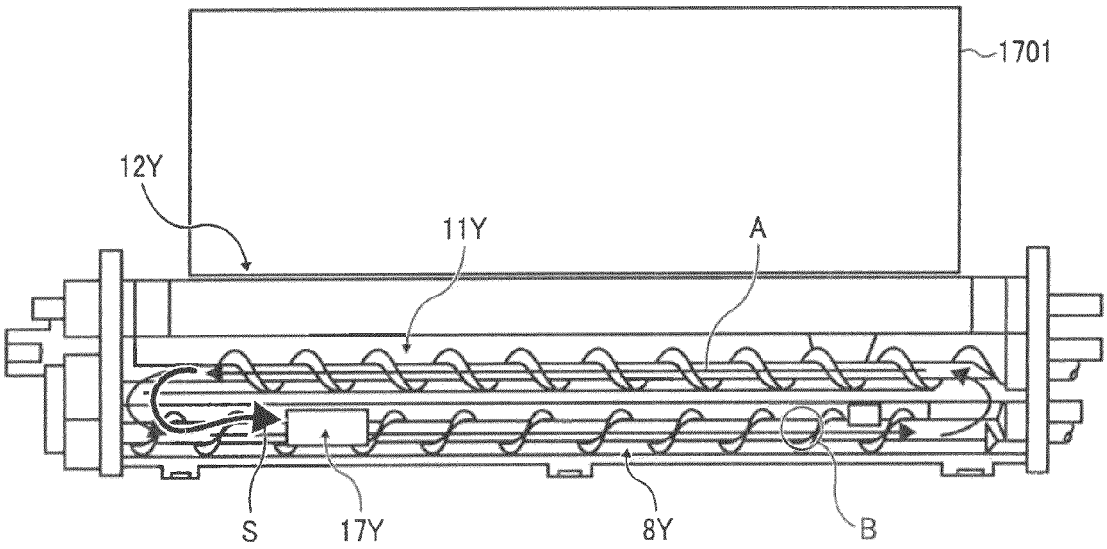
FIG. 17 is a schematic diagram of a recording medium and a moving path from a left end of the recording medium to a toner supply port, which are added to the schematic diagram of the developing unit shown in FIG. 4.

FIG. 17 is a schematic diagram of a recording medium and a moving path from the left end of the recording medium to the toner supply port 17, which are added to the schematic diagram of the developing unit 7Y shown in FIG. 4,. As shown in FIG. 17, a time in proportion to the advection velocity of the developer is required for the consumed toner at the second screw conveyor 11Y reaches the toner supply port 17. The minimum time corresponds a period of time from when the toner is consumed at the left end of a recording medium 1701 until it reaches the toner supply port 17. When a distance at that time is S and an advection velocity of the developer is u, the minimum required time is given by S/u.

Accordingly, the minimum time for the developer that consumes toner to reach the toner supply port 17 after a writing operation with the laser beam is S/u+T/v, which corresponds to the time d indicated in FIG. 15.

In contrast, as shown in FIG. 14, when a dividing size of each of the regions in the sub-scanning direction is h, the relation between the writing time for each of the regions and the acquisition time of the data is given by h/v.

Therefore, when inequality of S/u+T/v>h/v is satisfied, optimum supply of toner according to an amount of toner used for forming an image can be supplied without delay after the image information in each of the regions is written.

Figure 18:
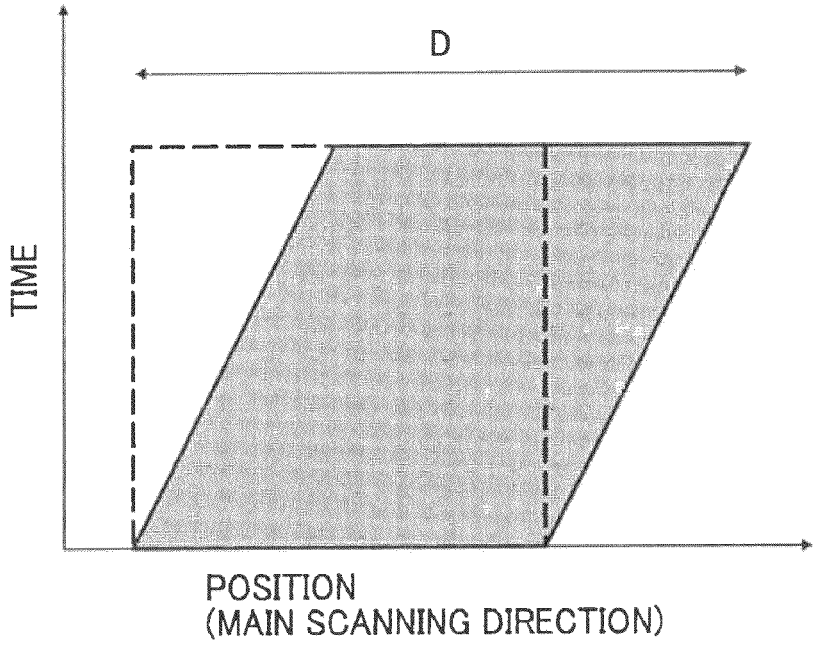
FIG. 18 is a graph of a positional change of developer over time.

FIG. 18 is a graph of a positional change of the developer over time. When the toner is continuously consumed at the same position in the main-scanning direction, the developer that consume toner shifts like that shown in FIG. 18 due to advection of the developer in the developing unit 7Y. Reducing a distance D shown in FIG. 18 indicating shifting of the developer in the main-scanning direction is advantageous for high-stability control. In a modification, the image-information acquisition region is divided in such a manner that the distance D is the minimum. A condition for minimizing the distance D is described below.

Figure 19:
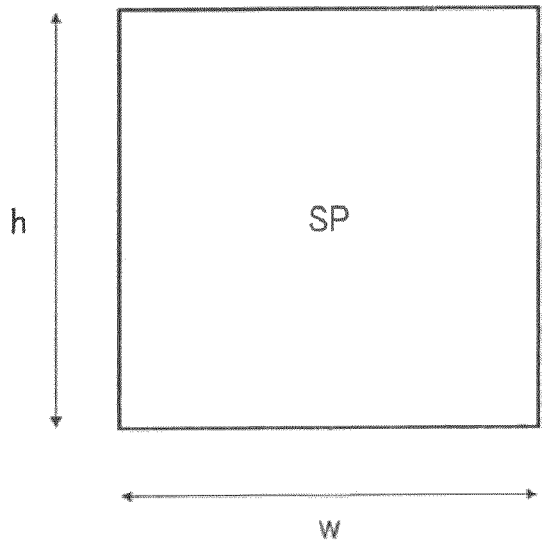
FIG. 19 is a schematic diagram of a single region that is divided.

FIG. 19 is a schematic diagram of a single divided region. As shown in FIG. 19, a length of the divided region in the main-scanning direction (main-scanning dividing length) is represented as w, a length of the divided region in the sub-scanning direction (sub-scanning dividing length) is represented as h, and the area of the region is represented as SP.

A distance D in the divided region is given by Equation (1) below:

$$D(w, h)=w+(h/v)\times u \quad (1)$$

where, v is a linear velocity of the photosensitive element 3Y, and u is an advection velocity of the developer.

Based on w×h=SP, Equation (1) can be expressed as the following Equation (2):

$$D(w)=w+(SP\times u)/(w\times v) \quad (2)$$

The value of w that minimizes D is given by the following Equation (3) based on dD(w)/dW|(w=w*)=0:

$$w^*=SP\hat{}(1/2)\times(u/v)\hat{}(1/2) \quad (3)$$

The value of h(=h*) that minimizes D is given by the following Equation (4) based on w*×h*=SP:

$$h^*=SP\hat{}(1/2)\times(v/u)\hat{}(1/2) \quad (4)$$

Accordingly, the following Inequalities (5) and (6) are obtained:

$$u/v<1\rightarrow w^*<h^* \quad (5)$$

$$u/v>1\rightarrow w^*>h^* \quad (6)$$

In other words, if the advection velocity is smaller than the linear velocity, the region is divided in such a manner that the main-scanning dividing length is smaller than the sub-scanning dividing length. In a similar manner, if the advection velocity is larger than the linear velocity, the region is divided in such a manner that the main-scanning dividing length is larger than the sub-scanning dividing length.

Figure 20:
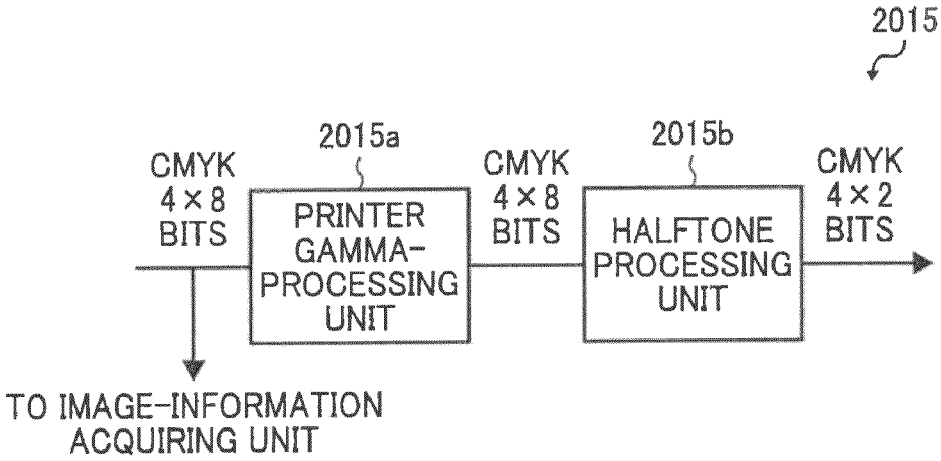
FIG. 20 is a block diagram of a modification of a printer correcting unit.

In the above-described embodiment, as shown in FIG. 8, the image information that has been subjected to halftone processing in the halftone processing unit 615*b* in the printer correcting unit 615 is sent to the image-information acquiring unit 103; however, the configuration is not limited thereto. For example, the image information before printer gamma correction can be sent to the image-information acquiring unit 103. FIG. 20 is a block diagram of a modification of a printer correcting unit 2015 configured in this manner. As shown in FIG. 20, the printer correcting unit 2015 includes a printer gamma-processing unit 2015*a* that performs printer gamma correction for each of the CMYK colors; and a halftone processing unit 2015*b* that performs halftone processing according to properties of the process units 1Y, 1C, 1M, and 1K. The image information that is subjected to halftone processing is modulated with a laser beam by the optical writing unit 20. As shown in FIG. 20, in the modification, the image information before the gamma conversion is sent to the image-information acquiring unit 103. Values of the image information before the gamma conversion are associated with density values of the last image. Because density values are proportional to a consumption amount of toner, by using the image information before the gamma conversion, a consumption amount of toner can be more accurately obtained, thus configuring an image forming apparatus that performs image formation in a stable density manner.

As described above, the image forming apparatus according to the first embodiment calculates the prediction data containing the temporal variation in the toner density occurring at a specific point due to development and adjusts the supply amount of toner at a predetermined supply point based on the prediction data. Because the two-component developer circulates in the developer circulation path, the uneven toner density of the two-component developer can be acquired as a temporal variation in the toner density of the two-component developer passing through a specific point. Based on the prediction data corresponding to the predicted value of the temporal variation in the toner density, the supply amount of toner at the predetermined supply point is adjusted in such a manner that the temporal variation in the toner density of the two-component developer passing through the specific point is eliminated. Accordingly, it is possible to eliminate the uneven toner density of the two-component developer at least at the specific point.

In the first embodiment, an object to be controlled by the supply control means is one (single) driving source included in the toner supplying means. Accordingly, only one driving source is needed to supply toner that is required for cancelling out the uneven toner density. Therefore, a problem of an increase in the size of apparatuses or in costs does not occur, which is a problem in technologies disclosed in Japanese Patent Application Laid-open No. H11-219015 and Japanese Patent Application Laid-open No. 2006-171177 in which a plurality of driving sources are required to cancel out the uneven toner density.

In addition, in the first embodiment, the toner supply control can be performed by calculating the supply amount of toner based on the divided image information, which makes it possible to implement more accurate control.

The configuration of the image-information acquiring unit 103 according to a second embodiment is the same as that of the first embodiment. Based on this, in the second embodiment, as a method of obtaining the same effect as that of decomposing the prediction data calculated by the prediction-data calculating unit 101 of the first embodiment using the supply waveform, as described later, by using an antiphase filter that instructs a supply amount of toner that creates the supply waveform with an opposite phase to the consumption waveform by taking into consideration supply waveform in advance, the supply amount for each control sampling that makes a supply result have an opposite phase to the prediction data is directly calculated from the image information.

Figure 21:
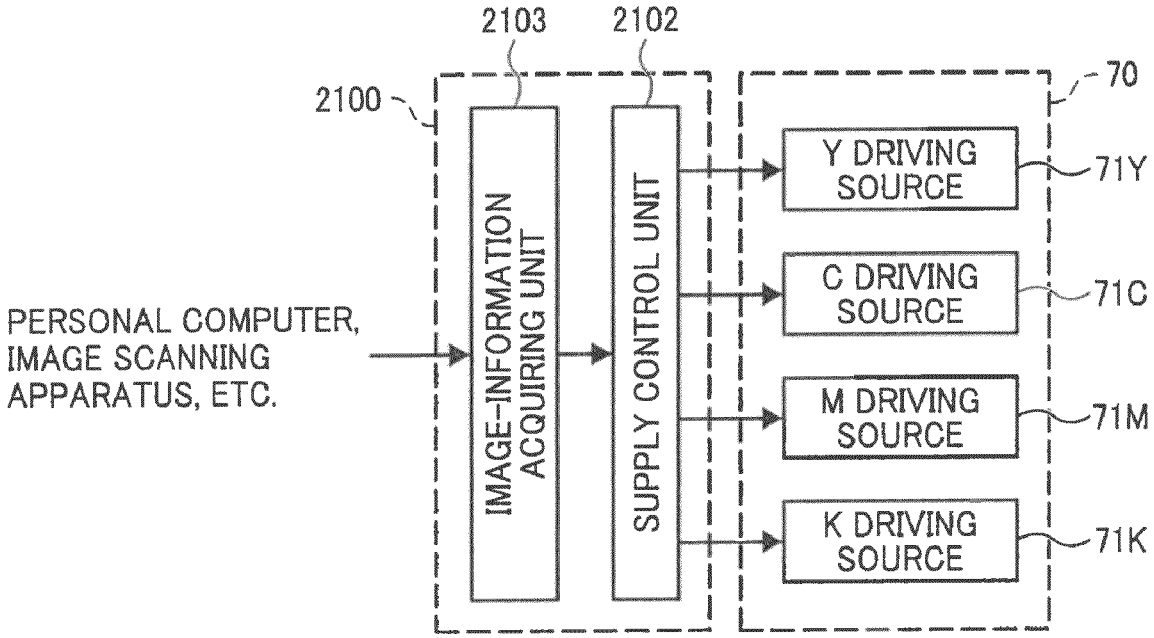
FIG. 21 is a functional block diagram of a mechanism that performs toner supply control according to a second embodiment.

FIG. 21 is a functional block diagram of a mechanism that performs toner supply control according to the embodiment. As shown in FIG. 21, in a similar manner as in the first embodiment, an image-information acquiring unit 2103 serving as image-information acquiring means that acquires image data (image information) from the personal computer or the image scanning apparatus is arranged in a control unit 2100.

A supply control unit 2102 includes the antiphase filter (not shown) that directly calculates the supply amount based on the image information. The image-information acquiring unit 2103 sends to the antiphase filter a later-described false impulse signal according to the acquired image information. From the received false impulse signal, the antiphase filter creates a supply pattern having a waveform of the supply result with an opposite phase to the prediction data and calculates the supply amount for each control sampling period from the supply pattern based on the image information. In the second embodiment, the supply amount is also calculated based on the image information that is received from the personal computer or the image scanning apparatus; however, the configuration is not limited thereto. For example, the supply amount can be calculated based on image information obtained by counting the number of the laser beams (number of dots) emitted from the optical writing unit 20.

The antiphase filter can be obtained by experiments in advance. A process of creating the antiphase filter is described below.

First, a toner-density sensor is arranged at the measurement point B (see FIG. 4). The toner-density sensor detects toner density of the developer passing through the measurement point B located downstream of the toner supply port 17 in the first developer container 9Y in the developer circulation direction. Toner is supplied from the toner supply port 17, and temporal variation (supply waveform) in the toner density at the measurement point B is measured by the toner-density sensor. The supply waveform measured in this manner is like that a graph shown in FIG. 22B. In addition, in the second embodiment, only a single pattern of supply waveform produced when toner is supplied by a typical supply amount is measured as a unit of supply waveform.

Next, the surface of the photosensitive element is divided into multiple regions in the direction orthogonal direction with respect to the moving direction of the surface of the photosensitive element 3Y (main-scanning direction). Latent images in the same image units corresponding to a unit area for detecting the toner density are formed in each of the regions. Temporal variation (consumption waveform) in the toner density of the developer after the developer with uniform toner density has been used for developing the latent images is measured by the toner-density sensor at the measurement point B without supplying additional toner.

One dot area of the image information is ideally used for the unit area for detecting the toner density when calculating the consumption waveform; however, in practice, the size of the region is limited by the resolution of the sensor, noise effect, or a performance of supplying a small amount of toner by the toner supplying unit 70. Accordingly, it is preferable to set the unit area for detecting the toner density as small as possible taking into consideration the above-mentioned factors. For example, when the resolution of the image information is low or a processing speed of the controller is limited, by using the entire region of one printing sheet as the minimum unit of the unit area, the amplitude of the consumption waveform can be approximated to the entire image area in each printing sheet.

The intervals of dividing the surface of the photosensitive element 3Y into multiple regions in the above-described manner are appropriately set according to the unit area for detecting the toner density.

Figure 22A:
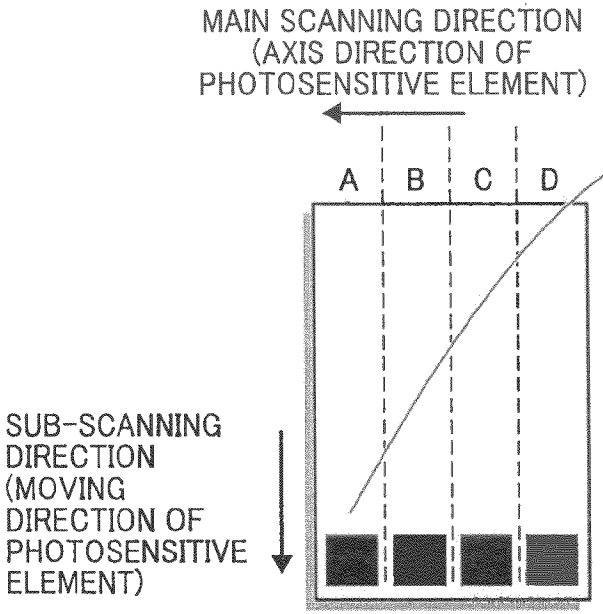
FIGS. 22A and 22B are a schematic diagram of the relation among the divided region, a toner supply waveform, and a consumption waveform.
Figure 22B:
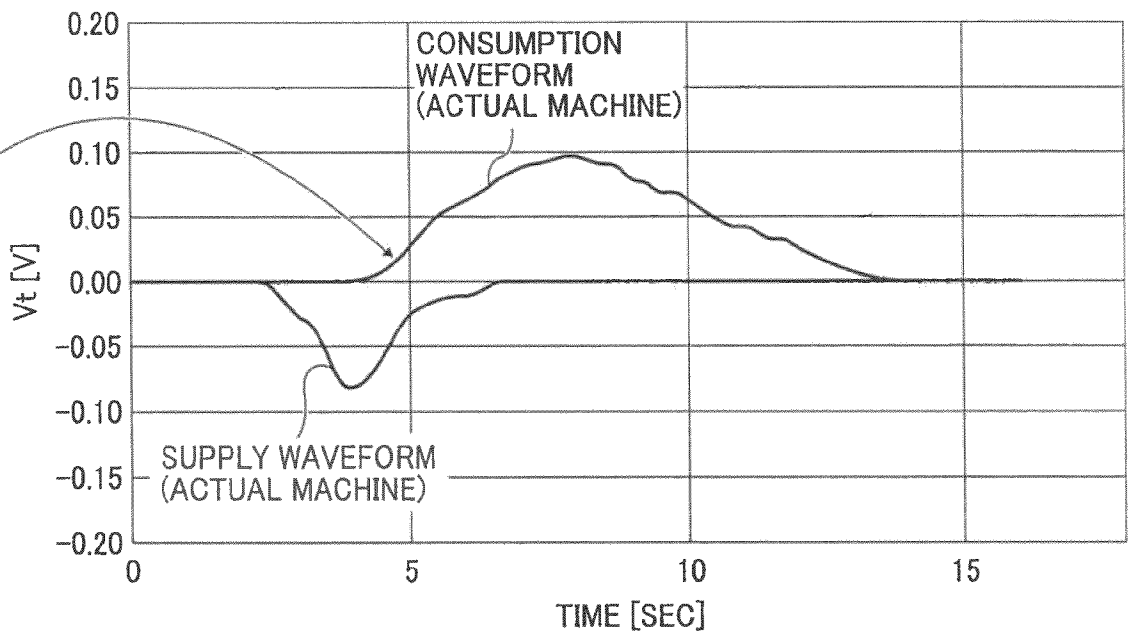

The consumption waveform measured in this manner is like a graph shown in FIG. 22B. However, only a consumption waveform in a region A is illustrated in the graph in FIG. 22B from among the multiple regions illustrated in FIG. 22A.

Figure 23:
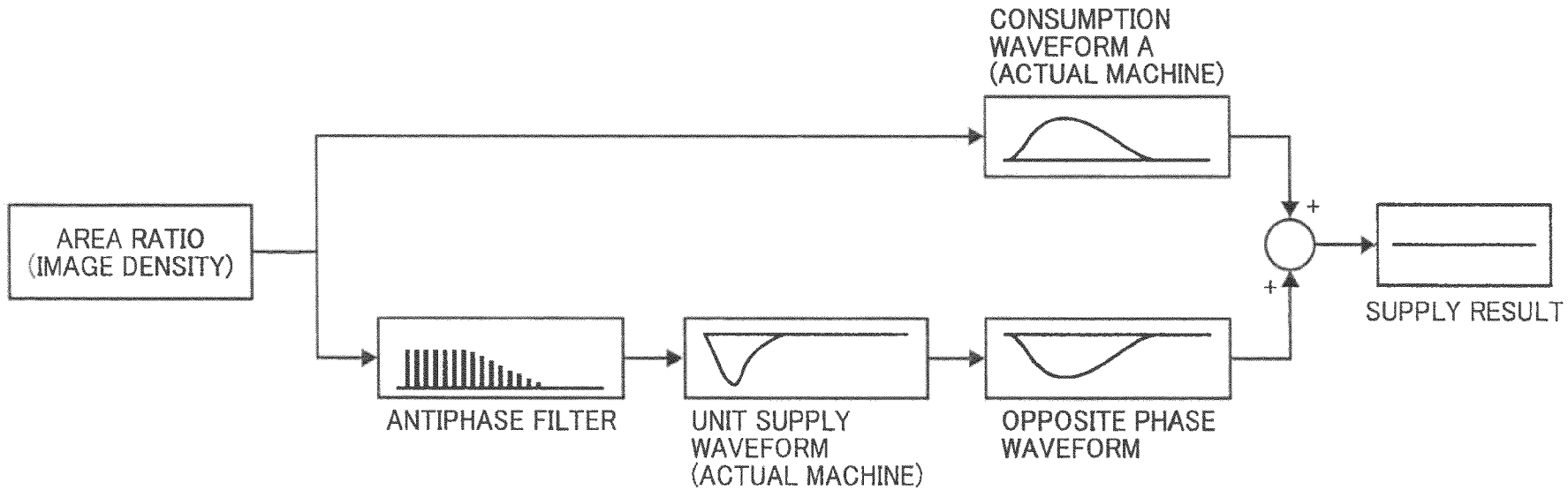
FIG. 23 is an explanatory diagram of the relation between an antiphase filter and other waveforms.

The antiphase filter that satisfies the relation shown in FIG. 23 is formed based on the supply waveform and the consumption waveform obtained in the above-mentioned manner. The vertical axis of the antiphase filter shown in FIG. 23 indicates an instruction value of supply amount (amount of toner [mg] or reduced value of motor driving time [msec], etc.) for each control sampling period. The horizontal axis of the antiphase filter indicates a control sampling period (a single sample period corresponds to a gap between the vertical lines illustrated in the graph of the antiphase filter and is typically a fixed value, for example, 200 [msec]).

Figure 24:
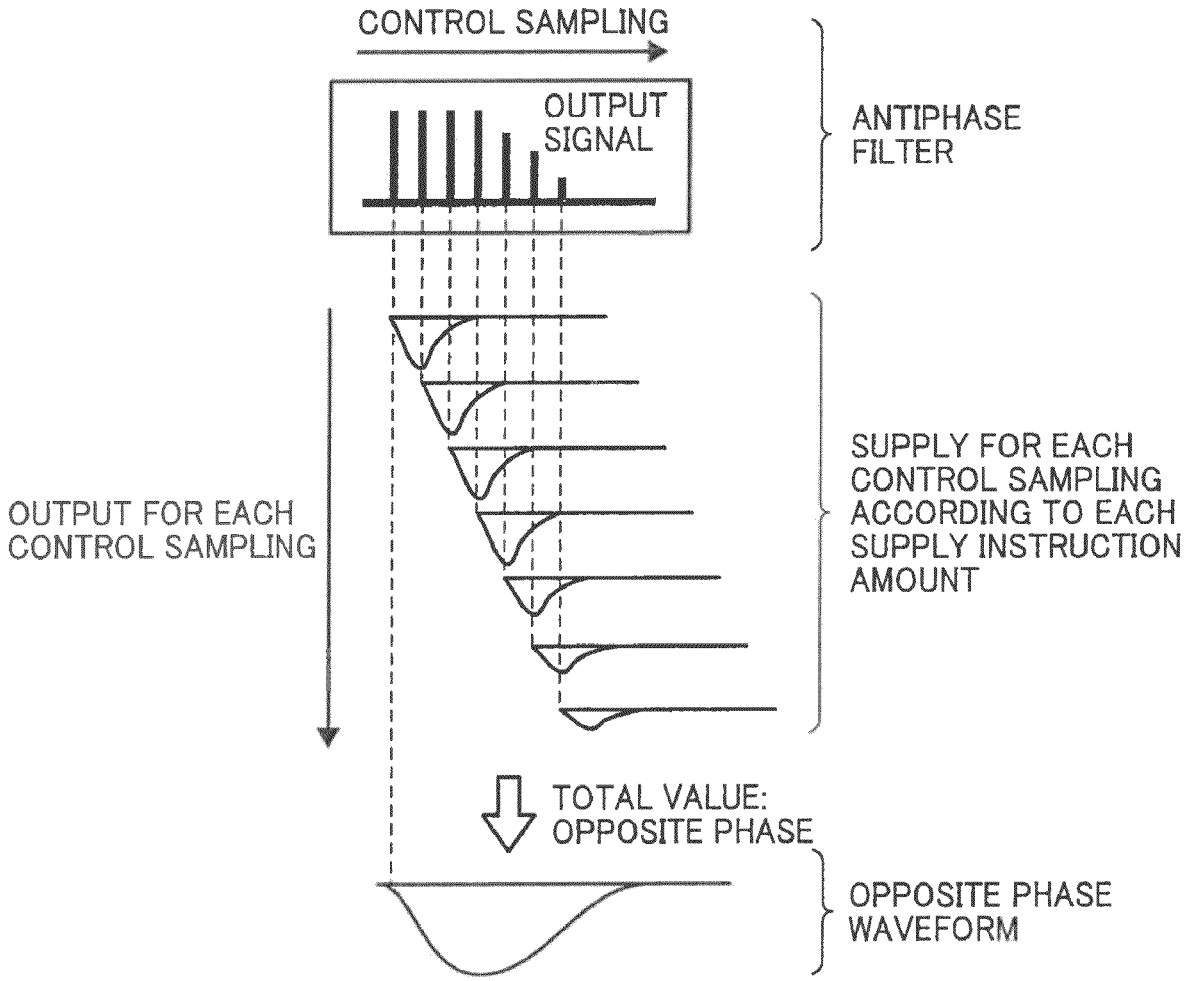
FIG. 24 is an explanatory diagram of the relation among the antiphase filter (supply signal), supply waveforms, and an opposite phase waveform.

Brief explanation is given with reference to FIGS. 23 and 24 as below. When toner corresponding to an arbitrary image area ratio is consumed at one time, a false impulse signal corresponding to the image area ratio is sent to the antiphase filter. The image area ratio represents a pixel ratio of pixel values other than zero in the unit area. When the pixel value is a binary value (0 or 1), the image area ratio corresponds to the average of the pixel values. When the pixel value is a multi-level value (for example, 0 to 3), a value divided by the average of the pixel values by the maximum pixel value can be used instead of the image area ratio. A case where the image area ratio is used is described below as an example.

The antiphase filter creates impulse responses for each control sampling period based on the false impulse signals and then creates opposite phase waveforms that instruct the supply amount according to the amplitude of the impulse responses. By supplying the supply amount indicated by the opposite phase waveform, the consumption waveform is canceled out because the opposite phase waveform has an opposite phase to the consumption waveform. A system-identification method called a typically known "Filtered-X LMS" is used for creating the antiphase filter; however, the method of creating the antiphase filter is not limited thereto. For example, an FIR filter mounted on a digital signal processor (DSP) can be used for the antiphase filter, or one approximated by a parametric model using an IIR filter can be used.

If a time lag occurs between the consumption waveform and the supply waveform, time-delay elements can be separately arranged on both sides of the antiphase filter.

Figure 25A:
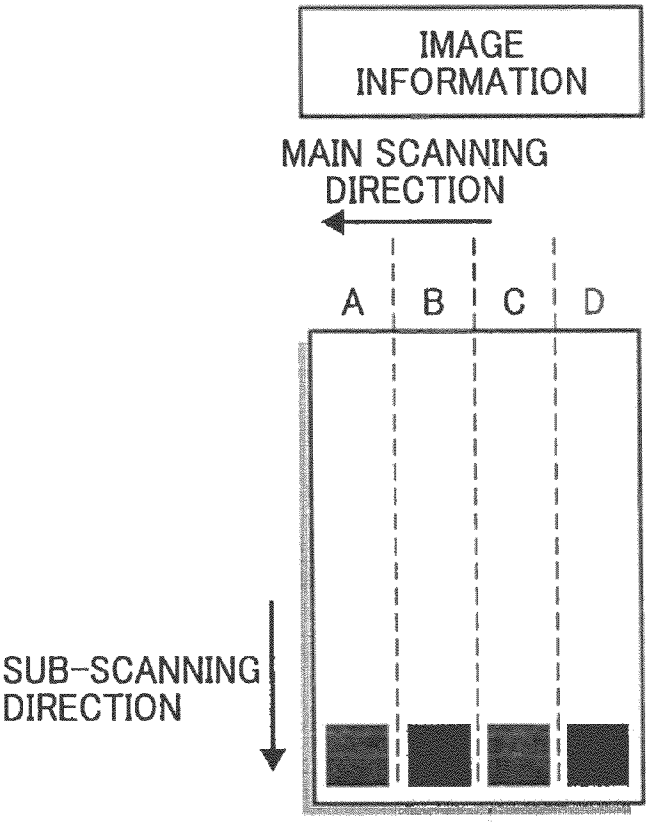
FIGS. 25A and 25B are an explanatory diagram of the relation between image information and antiphase filters with respect to consumption waveforms for each region in the main-scanning direction.
Figure 25B:
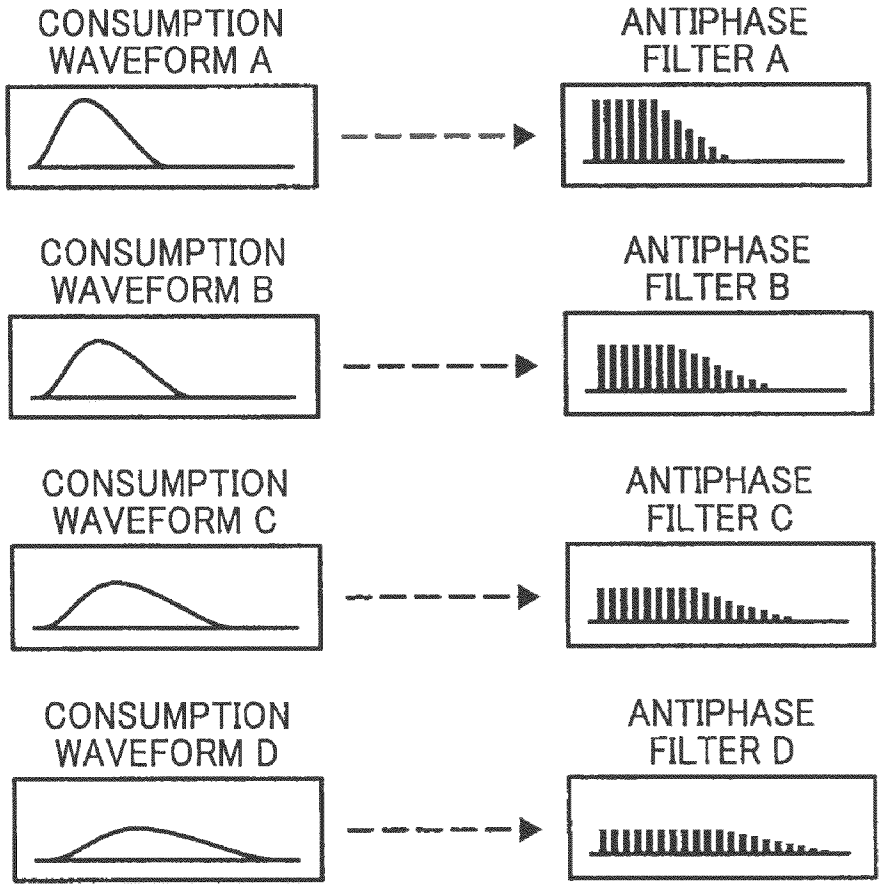

Based on the image information shown in FIG. 25A, when each of antiphase filters A, B, C, and D in association with each of the consumption waveforms A, B, C, and D in the minimum unit area for each region of the image in the main-scanning direction formed on the surface of the photosensitive element 3 that is divided into regions A, B, C, and D in the main-scanning direction is created using the above-mentioned method, schematic diagrams like those shown in FIG. 25B are obtained.

When a position of the image or an image area is changed, the supply amount of toner can be obtained by superimposing output results of the antiphase filters in the minimum unit area, whereby an arbitrary opposite phase waveform can be created. In other words, when a false impulse signal with an arbitrary amplitude is input to the antiphase filter at an arbitrary time, the antiphase filter automatically outputs an amplitude proportional to the subsequent input amplitude. The shape and the number of the antiphase filters are one in each region in the main-scanning direction. When different false impulse signals are sequentially input to the antiphase filter, the signals are automatically proportional to the input amplitudes, and then the antiphase filter outputs an opposite phase waveform that is shifted and superimposed by a time lag.

When the actual image area ratio is smaller than the minimum unit area, an amplitude of the false impulse signal input to the antiphase filter is multiplied by a ratio of the minimum unit area to the image area. By this process, an output value of the antiphase filter is automatically converted to a value multiplied by a ratio of the minimum unit area to the image area.

Figure 26:
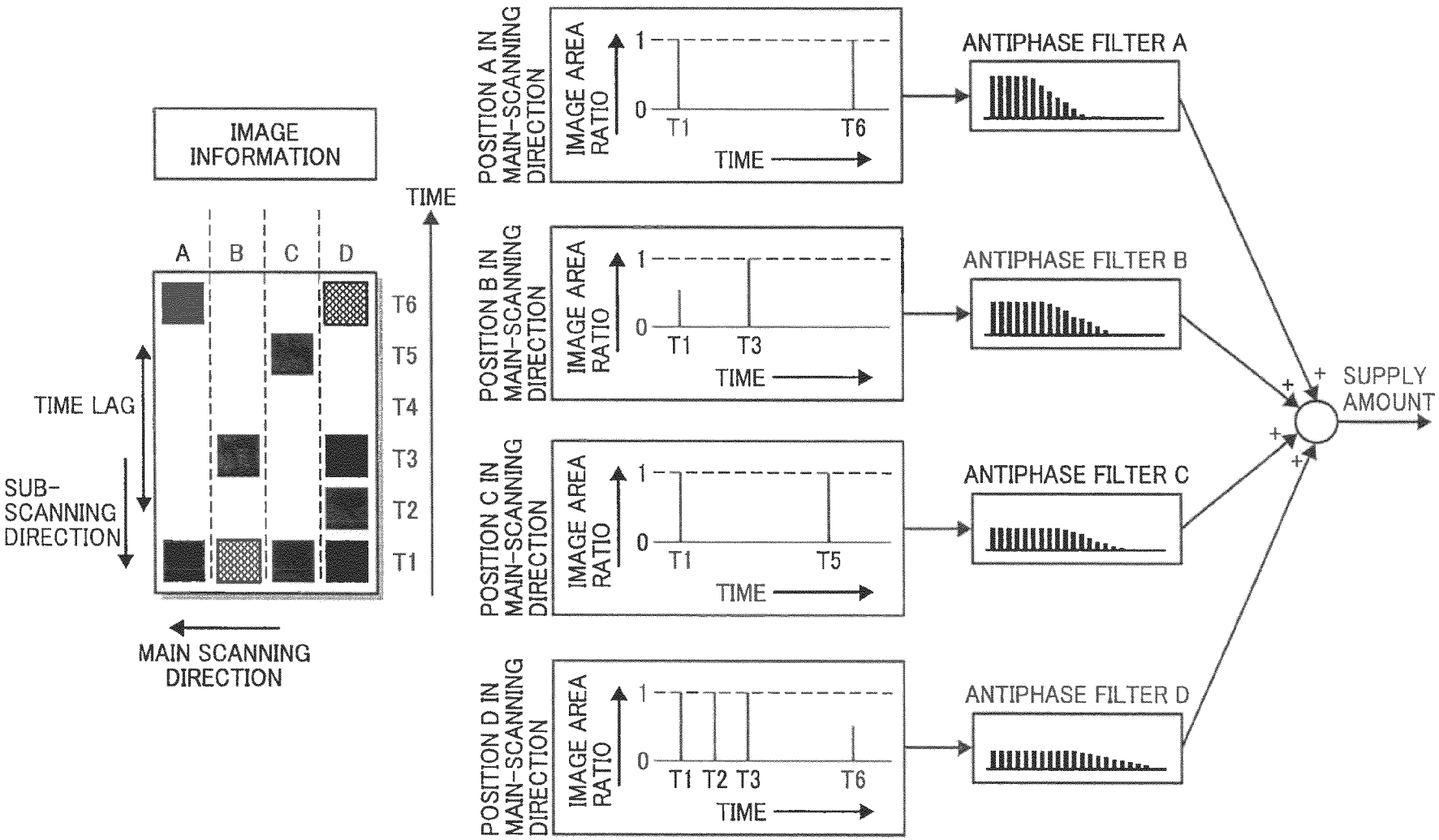
FIG. 26 is an explanatory diagram for explaining calculation of a supply amount using the antiphase filter based on the image information.
Figure 27:
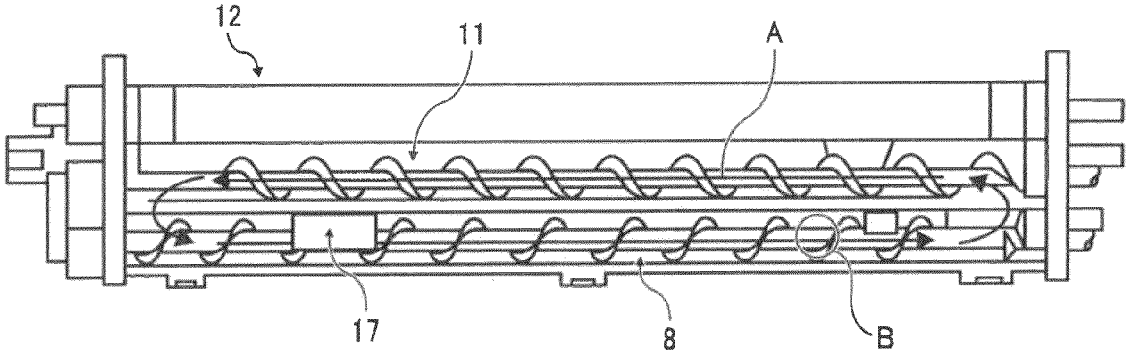
FIG. 27 is an explanatory diagram of an example of a developing device in which two-component developer circulates in a developer circulation path.
Figure 28:
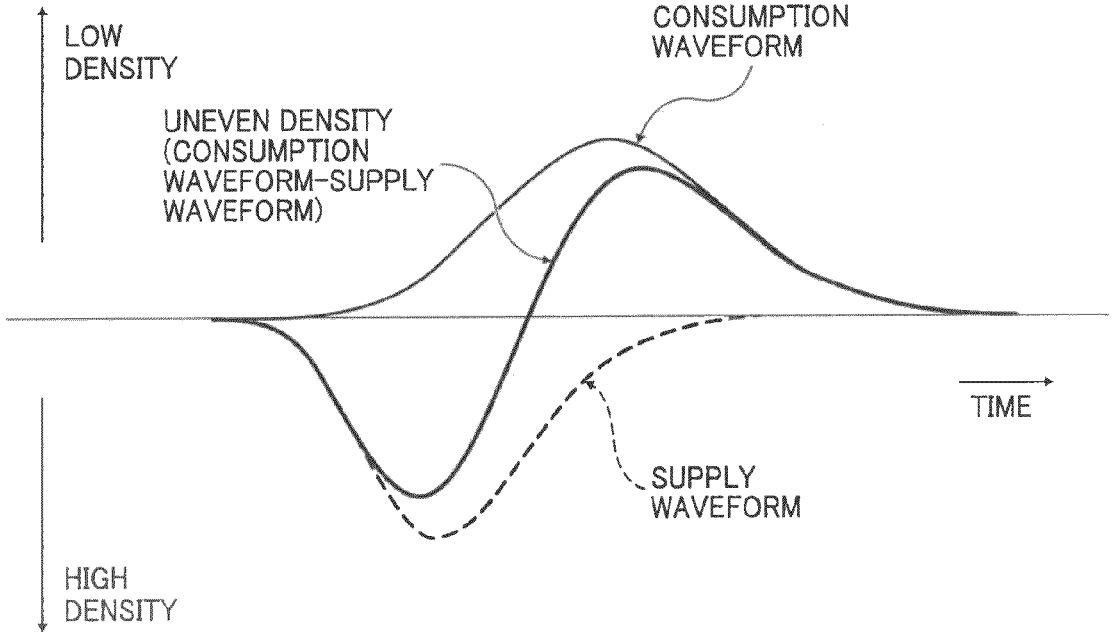
FIG. 28 is a graph of the relation between toner supply and uneven toner density when toner is supplied in one shot to the two-component developer.
Figure 29:
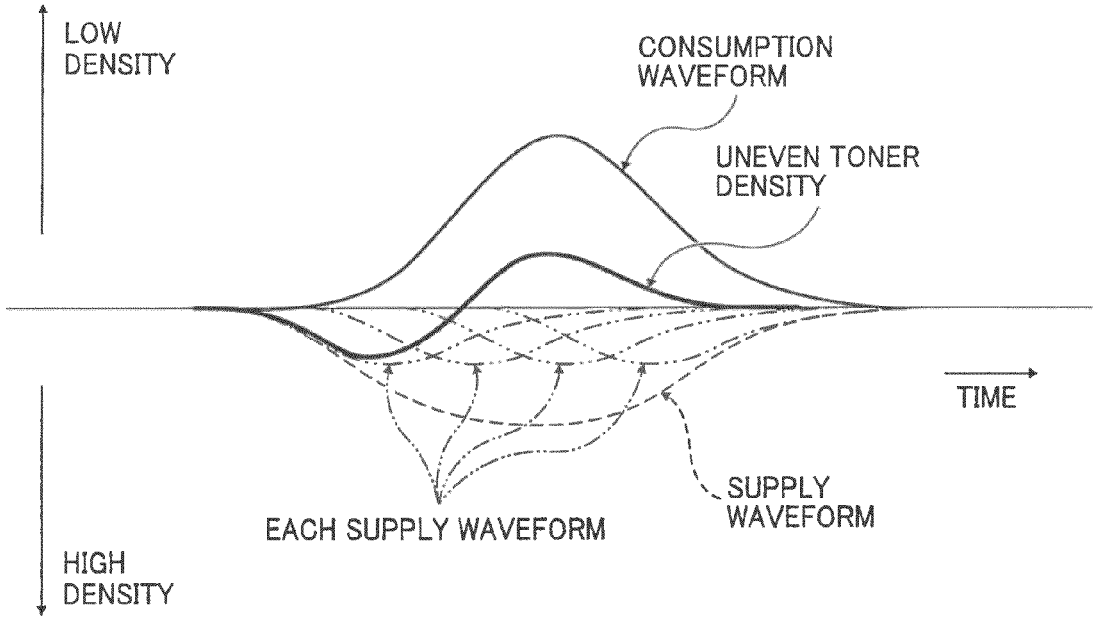
FIG. 29 is a graph of the relation between toner supply and uneven toner density when toner is supplied to the two-component developer at regular intervals.

Next, a case where uneven toner density at the measurement point B is eliminated by supplying toner by a supply amount based on prediction data of an opposite phase waveform that is calculated, from a consumption waveform with an opposite phase, using the antiphase filter based on the image information shown in FIG. 26 is described.

When a user performs printing based on the image information shown in FIG. 26, the image-information acquiring unit 2103 calculates an image area ratio at a position in the minimum unit area in each region A, B, C, and D of the surface of the photosensitive element 3 in the main-scanning direction. The image-information acquiring unit 2103 sends the false impulse signals having amplitudes according to the image area ratio to each of the antiphase filters in each region in the main-scanning direction, taking in consideration time lag of printing. Each of the antiphase filters creates the impulse responses for each control sampling period based on the false impulse signals and calculates the supply pattern having a waveform of the supply result with an opposite phase to the consumption waveform in each region in the main-scanning direction that indicates the supply amount according to the amplitudes of the impulse responses. The supply amount for each region in the main-scanning direction calculated in this manner is summed up for each control sampling period. The supply amount having an opposite phase to the prediction data of the temporal variation in toner density of the developer that passes through the measurement point B without supplying toner is calculated. Based on the supply amount, the supply control unit 2102 controls the toner supply operation of the toner supplying unit 70, and the toner supplying unit 70 supplies toner by a predetermined amount in each control sampling period. Because the waveform of the prediction data, which is obtained by superimposing the opposite phase waveforms to this supply in each region in the main-scanning direction, is an opposite phase waveform of the consumption waveform, it is possible to cancel out the consumption waveform produced when printing is performed based on the image information by supplying toner according to the above-mentioned supply amount by the toner supplying unit 70. Accordingly, uneven toner density at the measurement point B can be sufficiently eliminated.

According to an aspect of the present invention, it is possible to determine a toner supply operation in which temporal variation in toner density is eliminated based on image information and control a supply amount of toner based on the determined toner supply operation. Accordingly, uneven toner density of two-component developer can be eliminated without increasing in the size of apparatuses or in costs.

According to another aspect of the present invention, by using a filter that outputs a waveform instructing the supply amount of toner according to the image information, it is possible to determine the toner supply operation in which temporal variation in toner density is eliminated and to control the supply amount of toner based on the determined toner supply operation. Accordingly, uneven toner density of the two-component developer can be eliminated without increasing in the size of apparatuses or in costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image forming unit configured to form a latent image by irradiating an image carrier, which rotates or moves, with a light beam according to image information;

a conveying unit configured to convey and circulate two-component developer containing toner and carrier in a conveying path;

a toner supplying unit configured to supply toner to the two-component developer at a predetermined supply point in the conveying path;

a developing unit that develops the latent image formed on the image carrier with the two-component developer;

an acquiring unit that acquires the image information in units of divided image information obtained by dividing the image information at least in one of a main-scanning direction and a sub-scanning direction; and a supply control unit that calculates, based on the image information acquired by the acquiring unit, basic-supply patterns of a supply amount of toner in units of the divided image information and controls the supply amount of toner at the supply point using a toner supply pattern combined with calculated basic-supply patterns, the basic-supply patterns eliminating temporal variation in toner density of the two-component developer at a specific point in the conveying path due to development of the latent image according to the image information acquired by the acquiring unit.

2. The image forming apparatus according to claim 1, wherein the supply control unit calculates, based on the acquired image information, the basic-supply patterns in units of the divided image information and controls the supply amount of toner at the supply point using the toner supply pattern combined with the calculated basic-supply patterns, the basic-supply patterns indicating that temporal variation in the toner density of the two-component developer at the specific point due to supply of the toner has an opposite phase to temporal variation in the toner density of the two-component developer at the specific point due to the development of the latent image according to the acquired image information.

3. The image forming apparatus according to claim 1, wherein the acquiring unit acquires, in units of the divided image information, the image information including pixel values of pixels that are present in units of the divided image information, and the supply control unit calculates the basic-supply patterns in units of the divided image information and controls the supply amount of toner at the supply point using the toner supply pattern combined with the calculated basic-supply patterns, the basic-supply patterns being calculated by multiplying a control pattern of the supply amount of toner by a ratio of an average of the pixel values included in the image information that is acquired in units of the divided image information to a maximum pixel value, and the control pattern eliminating temporal variation in the toner density of the two-component developer at the specific point when performing development of the latent image based on the image information in which all pixels included in units of the divided image information have the maximum pixel value.

4. The image forming apparatus according to claim 1, wherein the acquiring unit acquires, in units of the divided image information, the image information including pixel values of pixels that are present in units of the divided image information, and the supply control unit calculates the basic-supply patterns in units of the divided image information and controls the supply amount of toner at the supply point using the toner supply pattern combined with the calculated basic-supply patterns, the basic-supply patterns being calculated by multiplying a control pattern of the supply amount of toner by a ratio of number of pixels whose pixel values included in the image information acquired in units of the divided image information are other than a minimum pixel value to number of all pixels, and the control pattern of the supply amount of toner eliminating temporal variation in the toner density of the two-component developer at the specific point when performing development of the latent image based on the image information in which all pixels included in units of the divided image information have a maximum pixel value.

5. The image forming apparatus according to claim 1, further comprising a prediction-data calculating unit that calculates prediction data in units of the divided image information, the prediction data indicating a predicted value of temporal variation in the toner density of the two-component developer at the specific point due to the development of the acquired image information, wherein the supply control unit controls the supply amount of toner at the supply point using the toner supply pattern combined with the basic-supply patterns that are set, in advance, to have an opposite phase to the prediction data in units of the divided image information.

6. The image forming apparatus according to claim 1, wherein the acquiring unit acquires the image information in units of the divided image information obtained by dividing the image information at a predetermined divided position where at least one of a main-scanning effective area representing an acquirable area of the image information in the main-scanning direction and a sub-scanning effective area representing an acquirable area of the image information in the sub-scanning direction is divided.

7. The image forming apparatus according to claim 6, wherein the acquiring unit acquires the image information in units of the divided image information, the image information being divided at the divided position where only the sub-scanning effective area is divided.

8. The image forming apparatus according to claim 7, wherein the acquiring unit acquires the image information in units of the divided image information obtained by dividing the image information at the divided position where the sub-scanning effective area is divided by a predetermined length h that satisfies Inequality (1):

$$S/u+T/v>h/v \quad (1)$$

where, S is a distance, in the conveying path, from a position where toner is initially consumed in the conveying path to the supply point; u is an advection velocity of the two-component developer in the conveying path; T is a distance from a position where the image carrier is irradiated with the light beam to a position where the latent image is developed by the developing unit on the image carrier; and v is a moving speed of the image carrier.

9. The image forming apparatus according to claim 6, wherein the acquiring unit acquires the image information in units of the divided image information obtained by dividing the image information at the divided position where the sub-scanning effective area is divided by a predetermined length h that satisfies following Inequality (2) and the main-scanning effective area is divided by a predetermined length w that satisfies the following Inequality (2):

$$\text{when } u>v,\ w>h;\ \text{or when } u<v,\ w<h \quad (2)$$

where, u is an advection velocity of the two-component developer in the conveying path, and v is a moving speed of the image carrier.

10. The image forming apparatus according to claim 1, further comprising:

a gamma correcting unit that performs gamma correction of the image information; and a halftone processing unit that subjects the image information to halftone processing after the gamma correction, wherein the latent image forming unit forms the latent image by irradiating the image carrier, which rotates or moves, with the light beam according to the image information subjected to the halftone processing; and the acquiring unit acquires the image information subjected to the halftone processing in units of the divided image information.

11. The image forming apparatus according to claim 1, further comprising:

a gamma correcting unit that performs gamma correction of the image information; and a halftone processing unit that subjects the image information to halftone processing after the gamma correction, wherein the latent image forming unit forms the latent image by irradiating the image carrier, which rotates or moves, with the light beam according to the image information subjected to the halftone processing; and the acquiring unit acquires the image information that has not been subjected to the gamma correction in units of the divided image information.

12. An image forming method implemented on an image forming apparatus, the image forming apparatus comprising a latent image forming unit configured to form a latent image by irradiating an image carrier, which rotates or moves, with a light beam according to image information; a conveying unit configured to convey and circulate two-component developer containing toner and carrier in a conveying path; a toner supplying unit configured to supply toner to the two-component developer at a predetermined supply point in the conveying path; and a developing unit that develops the latent image formed on the image carrier with the two-component developer, the image forming method comprising:

acquiring the image information in units of divided image information obtained by dividing the image information at least in one of a main-scanning direction and a sub-scanning direction; and calculating, based on the image information acquired at the acquiring, basic-supply patterns of a supply amount of toner in units of the divided image information and controlling the supply amount of toner at the supply point using a toner supply pattern combined with calculated basic-supply patterns, the basic-supply patterns eliminating temporal variation in toner density of the two-component developer at a specific point in the conveying path due to development of the latent image according to the image information acquired at the acquiring.

* * * * *